US006684583B2

(12) United States Patent
Hodges et al.

(10) Patent No.: US 6,684,583 B2
(45) **Date of Patent: *Feb. 3, 2004**

(54) UTILITY PANEL SYSTEM

(75) Inventors: Ronald R. Hodges, Grandville, MI (US); George V. Weller, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/058,328

(22) Filed: Jan. 28, 2002

(65) Prior Publication Data

US 2002/0069601 A1 Jun. 13, 2002

Related U.S. Application Data

(63) Continuation of application No. 08/559,832, filed on Nov. 20, 1995, which is a continuation of application No. 08/271,376, filed on Jul. 6, 1994, now Pat. No. 5,487,246, which is a continuation of application No. 08/036,067, filed on Mar. 23, 1993, now Pat. No. 5,341,615, which is a continuation of application No. 07/639,513, filed on Jan. 19, 1991, now Pat. No. 5,209,035.

(51) Int. Cl.[7] ..... E04B 5/48

(52) U.S. Cl. ..... 52/220.7; 52/239

(58) Field of Search ..... 52/220.7, 239, 52/220.2, 220.3, 220.5, 36.4, 36.5, 36.1, 243, 731.5

(56) References Cited

U.S. PATENT DOCUMENTS

| | | | |
|---|---|---|---|
| 756,749 | A | 4/1904 | Watts, Jr. |
| 1,776,785 | A | 9/1930 | Davidson |
| 2,121,213 | A | 6/1938 | Small |
| 3,065,575 | A | 11/1962 | Ray |
| 3,090,164 | A | 5/1963 | Nelsson |

(List continued on next page.)

FOREIGN PATENT DOCUMENTS

| | | |
|---|---|---|
| AU | B7341787 | 2/1989 |
| CA | 1233616 | 3/1988 |
| GB | 0006707 A1 | 1/1980 |
| GB | 2172624 | 2/1985 |
| GB | 0200514 A1 | 11/1986 |

OTHER PUBLICATIONS

A brochure entitled *Knoll—Hannah Desk System*, 18 pages, dated Oct. 1986.

A brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

(List continued on next page.)

*Primary Examiner*—Carl D. Friedman
*Assistant Examiner*—Chi Q. Nguyen
(74) *Attorney, Agent, or Firm*—Price Heneveld Cooper DeWitt & Litton LLP

(57) ABSTRACT

A utility panel system is provided for open office spaces, and the like. Each utility panel has a relatively thick, skeleton-like frame, with a foot and opposite sides shaped for interconnection with like panel frames to create a substantially freestanding utility panel system. Cover panels are detachably connected to the opposite faces of each panel frame to enclose the same, and provide ready access to the panel interior. Horizontal utility troughs extend continuously between the opposite sides of each panel frame in a vertically stacked relationship. The utility troughs have open ends located at the opposite panel sides, and are positioned such that when adjacent utility panels are interconnected in a side-by-side relationship, the utility troughs are aligned to form multiple raceways. Panel connectors are provided to connect the utility panels with one or more of a variety of existing partition panels, such that the utility panels act as a spine which supplies utilities to the existing partition panels.

44 Claims, 22 Drawing Sheets

U.S. PATENT DOCUMENTS

| | | | | | |
|---|---|---|---|---|---|
| 3,101,817 | A | | 8/1963 | Radek | |
| 3,195,698 | A | | 7/1965 | Codrea | |
| 3,209,869 | A | * | 10/1965 | Hammitt | 403/252 |
| 3,304,683 | A | | 2/1967 | Ferreira | |
| 3,377,756 | A | | 4/1968 | Polhamus | |
| 3,425,568 | A | | 2/1969 | Albright | |
| 3,514,883 | A | | 6/1970 | Albright | |
| 3,601,432 | A | * | 8/1971 | Fenwick et al. | 403/230 |
| 3,697,034 | A | * | 10/1972 | Shell | 248/243 |
| 3,719,768 | A | | 3/1973 | Jonsson | |
| 3,745,732 | A | * | 7/1973 | Pritchard et al. | 52/239 |
| 3,749,432 | A | * | 7/1973 | Janssen | 52/476 |
| 3,802,146 | A | | 4/1974 | Tacke et al. | |
| 3,831,330 | A | | 8/1974 | Tacke et al. | |
| 3,888,059 | A | | 6/1975 | MacLennan et al. | |
| 3,888,440 | A | * | 6/1975 | Rebentisch | 248/73 |
| 3,983,670 | A | | 10/1976 | Lightfoot | |
| 4,015,397 | A | | 4/1977 | Flachbarth et al. | |
| 4,038,796 | A | | 8/1977 | Eckel | |
| 4,060,294 | A | | 11/1977 | Haworth et al. | |
| 4,144,924 | A | | 3/1979 | Vanden Hoek | |
| 4,154,419 | A | * | 5/1979 | Breidenbach | 248/243 |
| 4,203,639 | A | | 5/1980 | VandenHoek et al. | |
| 4,224,769 | A | | 9/1980 | Ball et al. | |
| 4,227,360 | A | * | 10/1980 | Balinski | 52/720 |
| 4,228,834 | A | | 10/1980 | Desnick | |
| 4,231,630 | A | | 11/1980 | Propst et al. | |
| 4,232,183 | A | | 11/1980 | Person | |
| 4,239,932 | A | | 12/1980 | Textoris et al. | |
| 4,257,203 | A | | 3/1981 | Propst et al. | |
| 4,270,020 | A | | 5/1981 | Kenworthy et al. | |
| 4,278,834 | A | | 7/1981 | Boundy | |
| 4,286,419 | A | | 9/1981 | Treffers | |
| 4,308,418 | A | | 12/1981 | Van Kuik et al. | |
| 4,367,370 | A | | 1/1983 | Wilson et al. | |
| 4,375,010 | A | | 2/1983 | Mollenkopf | |
| 4,382,648 | A | | 5/1983 | Propst et al. | |
| 4,391,073 | A | | 7/1983 | Mollenkopf et al. | |
| 4,406,101 | A | | 9/1983 | Heidmann | |
| 4,429,934 | A | | 2/1984 | VandenHoek et al. | |
| RE31,733 | E | | 11/1984 | Haworth et al. | |
| 4,485,597 | A | * | 12/1984 | Worrallo | 52/479 |
| 4,535,577 | A | | 8/1985 | Tenser et al. | |
| 4,559,410 | A | | 12/1985 | Hostetter | |
| 4,567,698 | A | * | 2/1986 | Morrison | 52/36.6 |
| 4,567,699 | A | | 2/1986 | McClellan | |
| 4,593,505 | A | | 6/1986 | Russell | |
| 4,619,486 | A | | 10/1986 | Hannah et al. | |
| 4,630,417 | A | | 12/1986 | Collier | |
| 4,631,881 | A | | 12/1986 | Charman | |
| 4,646,211 | A | | 2/1987 | Gallant et al. | |
| 4,660,339 | A | | 4/1987 | Paz | |
| 4,682,457 | A | | 7/1987 | Spencer | |
| 4,685,255 | A | | 8/1987 | Kelley | |
| 4,703,985 | A | | 11/1987 | Finkbeiner et al. | |
| 4,713,918 | A | | 12/1987 | Cioffi | |
| 4,720,953 | A | | 1/1988 | Onishi et al. | |
| 4,750,624 | A | | 6/1988 | Baron | |
| 4,771,583 | A | | 9/1988 | Ball et al. | |
| 4,795,355 | A | | 1/1989 | Dorn et al. | |
| 4,841,699 | A | | 6/1989 | Wilson et al. | |
| 4,862,659 | A | | 9/1989 | Wilson et al. | |
| 4,876,835 | A | | 10/1989 | Kelley et al. | |
| 4,882,885 | A | | 11/1989 | Chatterson et al. | |
| 4,883,330 | A | | 11/1989 | Armstrong et al. | |
| 4,899,018 | A | | 2/1990 | Sireci | |
| 4,905,428 | A | | 3/1990 | Sykes | |
| 4,932,177 | A | | 6/1990 | Hinden | |
| 4,942,805 | A | | 7/1990 | Hellwig et al. | |
| 4,944,122 | A | | 7/1990 | Wendt | |
| 4,979,554 | A | | 12/1990 | Nelson | |
| 4,991,365 | A | | 2/1991 | Jackson | |
| 5,038,539 | A | | 8/1991 | Kelley et al. | |
| 5,062,246 | A | | 11/1991 | Sykes | |
| 5,065,556 | A | | 11/1991 | DeLong et al. | |
| 5,065,559 | A | | 11/1991 | Zegel et al. | |
| 5,117,599 | A | | 6/1992 | Voss | |
| 5,177,917 | A | | 1/1993 | del Castillo Von Haucke | |
| 5,209,035 | A | | 5/1993 | Hodges et al. | |
| 5,214,889 | A | | 6/1993 | Nienhuis et al. | |
| 5,214,890 | A | | 6/1993 | Levitan et al. | |
| 5,341,615 | A | | 8/1994 | Hodges et al. | |
| 5,394,658 | A | | 3/1995 | Schreiner et al. | |

OTHER PUBLICATIONS

A publication entitled *Knoll—Hannah Desk System—Assembly Guide*, 12 pages, undated but published in 1986.

Prior art publication entitled *Elective Elements Cable Management Panel Installation* (7 pages).

Prior art publication entitled *Elective Elements Panel Assembly Installation* (12 pages).

Progetto 25.90 by Unifor, Inc. U.S.A., Long Island City, New York (5 pgs), date unknown—prior to Jan. 1, 1991.

Panneli PL by Unifor, Inc. U.S.A., Long Island City, New York (35 pgs), date unknown—prior to filing date of present application.

Knoll International—6"Power Panel by Knoll International, Inc. (16 pgs), prior to Aug., 1990.

* cited by examiner 7C
148
7B
150
149

7C
64
XVIII
63
XIX
64
58
60
150
149
XX
XX
64
61
64
62
XVIII
XIX 3
7C
65
22C
58
63
7C
22C
59
65
58
61
30
64
22A
8A 149
61
64
30
22A
8A
3
62

UTILITY PANEL SYSTEM

CROSS REFERENCE TO RELATED APPLICATIONS

This is a continuation of application Ser. No. 08/559,832, filed on Nov. 20, 1995, entitled UTILITY PANEL SYSTEM, which is a continuation of application Ser. No. 08/271,376, filed on Jul. 6, 1994, now U.S. Pat. No. 5,487,246, which is a continuation of application Ser. No. 08/036,067, filed on Mar. 23, 1993, U.S. Pat. No. 5,341,615, which is a continuation of Ser. No. 07/639,513, filed on Jan. 19, 1991, now U.S. Pat. No. 5,209,035.

BACKGROUND OF THE INVENTION

The present invention relates to portable partition arrangements for open office spaces, and the like, and in particular, to a utility panel system.

Portable partition systems for open office spaces, and other similar settings, are well known in the art. Individual partition panels are interconnected in different configurations to form separate offices or workstations. The partition panels are extremely durable, and can be readily disassembled and reassembled into alternative configurations to meet the ever-changing needs of the user. Examples of such partition systems are provided in U.S. Pat. Nos. 3,822,146; 3,831,330; and 4,144,924, which are owned by Steelcase Inc., the assignee of the present application.

Most such partition panels are capable of being electrified in some fashion, so as to provide electrical power at the various workstations for computers, typewriters, dictating equipment, and other electrical appliances. These partition panels are also typically capable of routing cabling for telephones, computers, signaling, etc. to the individual workstations. Examples of such panel wiring systems are disclosed in U.S. Pat. Nos. 4,429,934; 4,060,294; 4,228,834; 4,382,648. Wireways and/or raceways are normally provided within the interiors of the panels to carry the utilities throughout the panel system.

The space available in present panel systems for utility raceways is rather limited. This is particularly true of some of the older style partition panel systems. The advent of computerized workstations, with sophisticated communication systems, and other electronic support equipment has greatly increased the need for partition panels to carry more power and cabling throughout the panel system.

Since many users have already made a design commitment, as well as a substantial financial investment in a particular type of existing partition panel system, which panel system is otherwise fully functional and operable, it would clearly be beneficial to be able to easily adapt each such existing panel system for use in workstations having high intensity electrical requirements. Furthermore, it would also be highly beneficial to adapt such existing partition panel systems in a way that preserves their original aesthetic design theme or look, so as to avoid a cobbled or fragmented appearance.

SUMMARY OF THE INVENTION

An aspect of the present invention includes an upright partition for use in a modular office furniture system. The partition includes a frame comprising at least two elongated internal frame members each having outward opposing faces defining spaced apart parallel forward and rearward planes when viewed from a side edge of the frame. The at least two frame members lie between the forward and rearward planes and a plurality of elongated external frame members lie outboard of the forward and rearward planes. At least one of said external frame members is located along each said plane. Each external frame member has an inward face and an outward face, the inward face of each external frame member engaging and being connected to at least some of the associated outward faces of said internal frame members in an overlapping moment-resisting connection. A plurality of covers are each connected to said frame and have an inner surface, whereby an internal cavity is defined inward of the outward faces of said external frame members, and at least one utility management path is defined outward of said outward faces of the internal frame members and inward of the inner surfaces of the covers.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
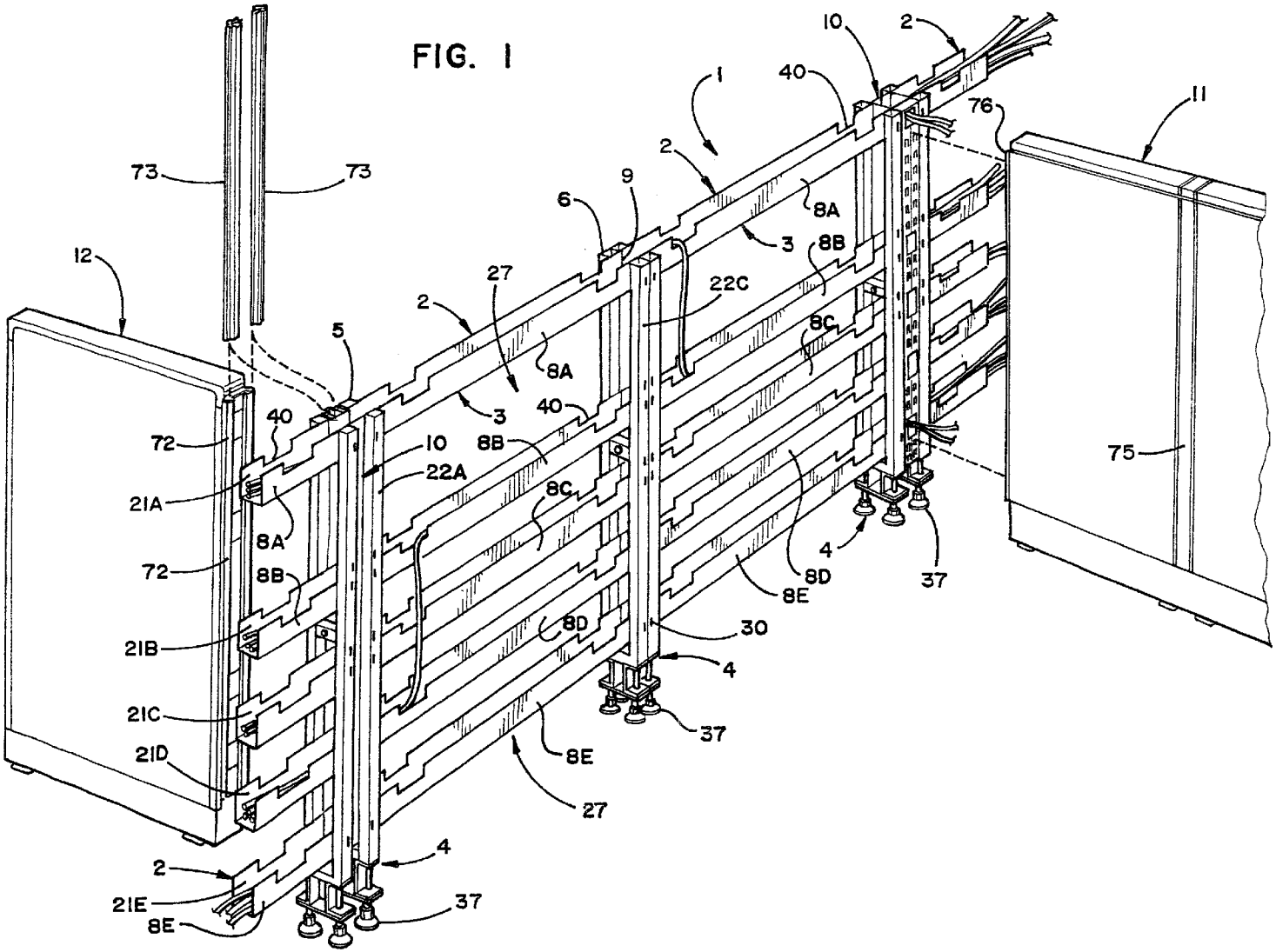
FIG. 1 is a perspective view of a utility panel system embodying the present invention, wherein utility panels, and existing partition panels are shown in a partially disassembled condition.

For purposes of description herein, the terms "upper", "lower", "right", "left", "rear", "front", "vertical", "horizontal" and derivatives thereof shall relate to the invention as oriented in FIGS. 1–5. However, it is to understood that the invention may assume various alternative orientation and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a utility panel system embodying the present invention. In the illustrated example, a plurality of individual utility panels 2 are provided, each having a relatively thick, skeleton-like panel frame 3, with a foot 4 and opposite sides 5 and 6 shaped for connection with like panel frames 3 to create a substantially freestanding utility panel system. Removable cover panels 7 (FIGS. 2 and 3) are detachably connected to the opposite faces of each of the panel frames 3 to enclose the same, and provide ready access to the panel interior. Horizontal utility troughs 8 (FIG. 1) extend continuously between the opposite sides 5 and 6 of each panel frame 3 in a vertically stacked relationship. The utility troughs 8 have open ends 9 located at the opposite panel sides 5 and 6, such that when adjacent utility panels 2 are interconnected in a side-by-side relationship, the utility troughs 8 are aligned to form multiple raceways in which various utilities can be carried. Panel connectors 10 are provided to connect the utility panels 2 with each other, and/or one or more of a variety of existing partition panels, such as the partition panels 11 and 12 illustrated in FIG. 1. In this configuration, utility panels 2 function as a spine, which supplies utilities to strings of existing partition panels 11 and 12.

As will be appreciated by those skilled in the art, utility panel system 1 is particularly adapted to route a wide variety of different utilities to the individual workstations within the open office. In the present example, utility panel system 1 is particularly adapted to route electrical wiring, and the like, such as 110 volt and 220 volt power lines, signal cables, communication lines, and other similar wiring and cabling that is required to equip and support modern office equipment. However, it is to be understood that other forms of utilities, such as fluid pipes for water, cooling, gases, fuels and the like, as well as air conditioning ducts, and other related utilities can also be routed through the utility panel system 1, such that the term "utilities" as used herein, is intended to include all such facilities.

With reference to FIGS. 3–6*a,* each utility panel 2 has a substantially similar construction, such that common reference numerals shall be used throughout for ease of description. Each utility panel 2 comprises an open skeleton-like panel frame 3 on which cover panels 7 are supported. A top cap 15 is provided to enclose and trim the upper portion of utility panel 2, and a base assembly 16 provides a utility power system along the lower portion of the utility panel 2, as described in greater detail hereinafter.

The illustrated panel frame 3 includes five separate utility channels or troughs 8*a–*8*e,* each of which extends generally horizontally between the opposite sides 5 and 6 of utility panel 2. Utility troughs 8*a–*8*e* are arranged in a mutual parallel, vertically stacked relationship. Each utility trough 8*a–*8*e* has a generally U-shaped side elevational configuration adapted to receive and retain various utilities therein. Utility troughs 8*a–e* are substantially identical in construction, and include a base or web 18, with a pair of upstanding flanges 19 and 20 at opposite sides of web 18. Utility troughs 8*a–e* are relatively wide, in the nature of 2–3 inches, and deep around 3–4 inches, and form channel-shaped wireways or raceways 21*a–e* designed for maximum utility carrying capacity, without unnecessarily impinging upon the interior space of utility panel 2. Utility troughs 8*a–e* are extremely rigid, and in the illustrated example, are constructed from formed sheet metal. Utility troughs are preferably constructed extremely rigid so that they not only form secure raceways 22*a–e,* but also provide structural rigidity and support to the overall panel frame 3.

Four vertical uprights 22*a–d* are positioned adjacent the opposite ends of utility troughs 8*a–e,* and are shaped to support cover panels 7 thereon. Vertical uprights 22*a–d* are positioned at the exteriors of utility troughs 8*a–e,* and extend laterally outwardly therefrom to avoid encroachment into the horizontal utility raceways 21*a–e,* and simultaneously create two vertical raceways 27 on opposite sides of the interior of the associated utility panel 2. In the illustrated example, vertical uprights 22 are substantially identical in construction, and comprise a rigid, hollow extrusion or tube which has a substantially rectangular horizontal cross-sectional shape (FIG. 6), comprising front and rear faces 23 and 24, and interior and exterior side faces 25 and 26 respectively. The rear faces 24 of vertical uprights 22*a–d* are fixedly attached to the exterior surfaces of flanges 19 and 20 of each of the utility troughs 8*a–e*. In the example shown in FIGS. 6 and 6A, the exterior side faces 26 of vertical uprights 22*a–d* are positioned in-line or flush with the ends 9 of the associated utility troughs 8*a–e*. Vertical uprights 22*a–d* and utility troughs 8*a–e* may be fixedly interconnected by a variety of different fastening techniques, and in the illustrated example are welded together. The rigid nature of both vertical uprights 22*a–d* and utility troughs 8*a–e,* as well as their rigid interconnection, creates a very strong and rigid open grid or skeleton-like frame 3, which does not require any auxiliary cross-bracing or the like, thereby maximizing the usable space within the interior of the utility panel 2.

Figure 5:
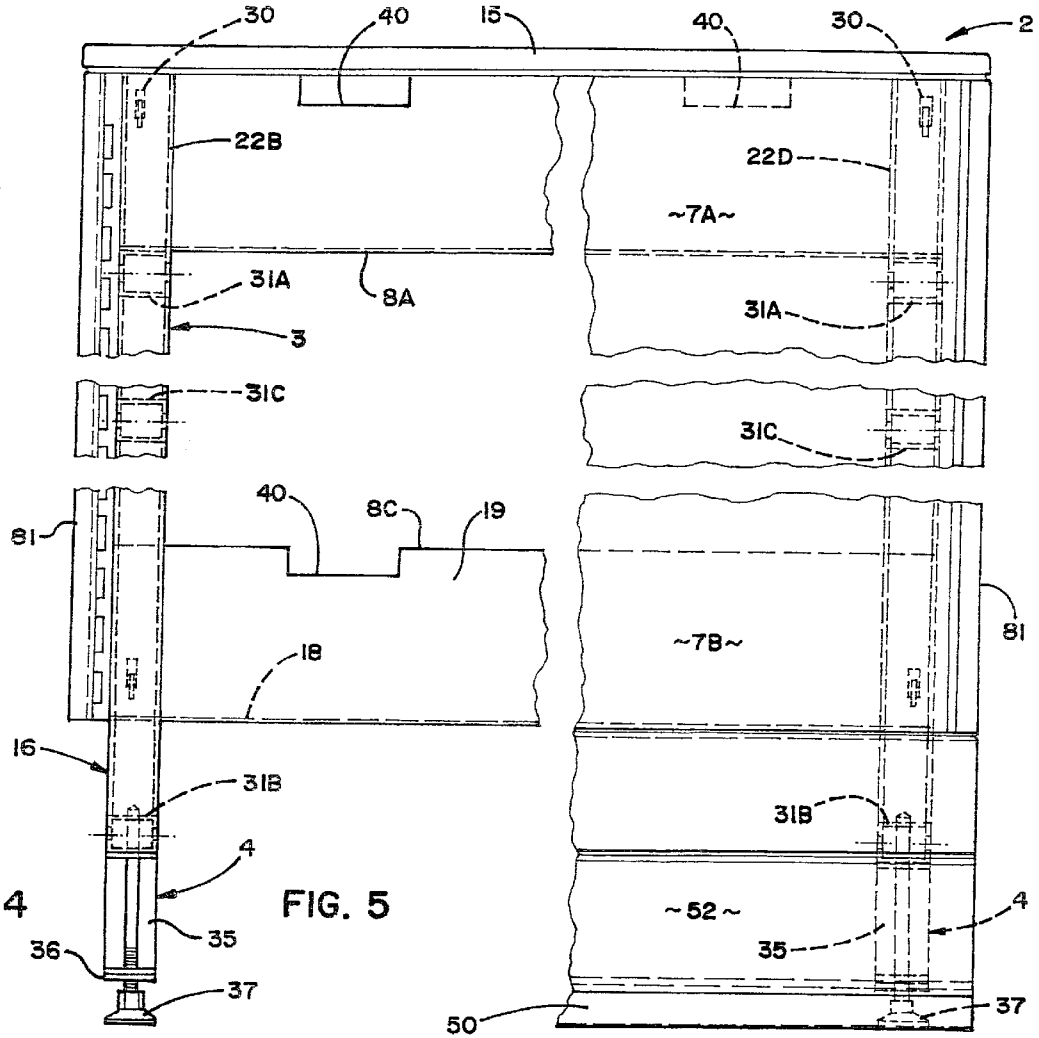
FIG. 5 is a fragmentary, front elevational view of the utility panel.
Figure 4:
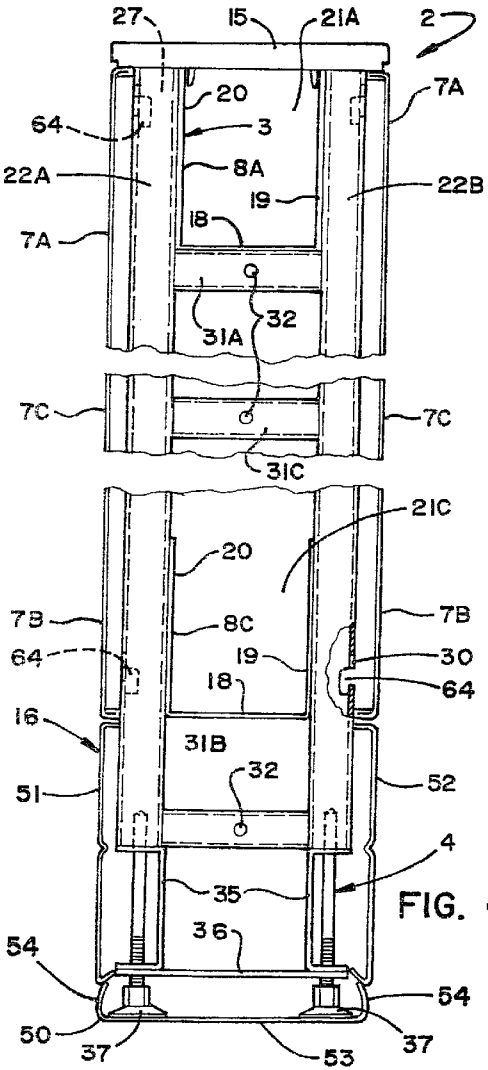
FIG. 4 is a fragmentary, side elevational view of the utility panel.

In the example illustrated in FIGS. 1–7A, each vertical upright 22*a–d* includes a plurality of hanger slots 30 extending through the front face 23 thereof into which hook shaped portions 64 of cover panels 7 are received, as described in greater detail hereinafter. Panel frame 3 includes three lateral connector brackets 31*a–c* disposed at the opposite ends of frame 2, which serve in interconnecting adjacent frames 3 in a side-by-side relationship. As best illustrated in FIGS. 4 and 5, connector brackets 31*a–e* have a rectangular tubular construction similar to vertical uprights 22*a–d,* and extend laterally in between the oppositely facing vertical uprights 22*a–b* and 22*c–d* respectively, with opposite ends fixedly attached thereto. The lowermost connector bracket 31*b* is positioned at the lower ends of vertical uprights 22, the uppermost connector bracket 31*a* is positioned directly below the uppermost utility trough 8*a,* and the medial connector bracket 31*c* is positioned in between utility troughs 8*b* and 8*c*. Each connector bracket 31*a–c* includes a fastener aperture 32 which extends laterally through the connector bracket in a direction parallel with the opposite faces of utility panel 2.

Each panel frame 3 also includes a dual glide foot assembly 4 attached to the lower ends of vertical uprights 22*a–d* at the opposite sides of utility panel 2. With reference to FIGS. 4 and 5, each panel foot assembly 4 includes a pair of C-shaped brackets 35 having their upper ends fixedly attached to the lower ends of vertical uprights 22*a–d,* and their lower ends interconnected by a rigid strap 36. Each side of the foot assembly 4 includes a pair of threaded apertures in which glide feet 37 are threadedly received. Axial rotation of glide feet 37 with respect to foot brackets 35 adjusts the relative height of panel frame 3. By providing each foot assembly 4 with a pair of vertically adjustable glide feet 37, utility panel 2 has good freestanding support, and the angular orientation of the utility panel with respect to the floor surface can be readily adjusted.

Each of the illustrated utility troughs 8*a–e* (FIG. 3) includes two pairs of notches or cutouts 40 extending through the upper edges of channel flanges 19 and 20. The flange notches 40 are positioned generally adjacent to the opposite ends of the utility troughs 8*a–e,* and are shaped to permit wires and/or other utilities to be pulled out from the associated utility trough, and routed into and through one of the vertical raceways 27. In this manner, wires, or the like can be easily brought to a service point at various vertical heights along utility panel 2, or routed through a different one of the utility troughs 8*a–e,* as best illustrated in FIG. 1. A raceway cover 41 (FIG. 3) may be used to enclose one or more of utility troughs 8, and has an inverted U-shaped configuration, having a central web 43, and depending flanges 44 along opposite sides thereof. The flanges 44 of raceway cover 41 are spaced so as to closely receive the opposite flanges 19 and 20 of utility troughs 8*a–e* therein to form a secure, closed raceway 21. The illustrated cover 41 includes notches 45 through side flanges 44, which align with the associated notches 40 in utility troughs 8*a–e* to permit wires to be routed into and through the vertical raceways 27.

The base assembly 16 (FIGS. 3–5) serves to enclose that portion of panel frame 3 disposed below the lowermost utility trough 8*e,* and comprises an upwardly facing, U-shaped base channel 50, with a pair of removable covers 51 and 52. Base channel 50 includes a flat web 53 which extends along the floor surface, and a pair of upstanding, flexible flanges 54, which serve as light seals along the base of utility panel 2. Glide feet 35 protrude through apertures in base web 53 to engage the floor directly. The base side covers 51 and 52 are detachable connected with panel frame 3, and enclose that portion of the panel frame disposed between the light seal flanges 54 and the lowermost edge of cover panels 7. Side covers 51 and 52 are manually removable with a snap fastener, or the like, so as to readily access any utilities placed therein, such as the illustrated powerway 56. Powerway 56 is the subject copending U.S. patent application Ser. No. 377,892 filed Jul. 10, 1989, entitled Modular Powerway For Partition Panels and the Like, which is assigned to the assignee of the present application, and is hereby incorporated herein by reference. However, it is to be understood that other types of powerways, and/or wiring systems can also be used in conjunction with utility panel 2.

Cover panels 7 (FIGS. 3–5) serve to cover the opposite faces of panel frame 3. In the illustrated example, each face of panel frame 3 includes three separate removable cover panels, comprising an upper cover panel 7*a,* a lower cover panel 7*b,* and intermediate cover panel 7*c*. Cover panels 7*a–7c* have a generally similar construction, comprising a rigid, pan-shaped inner panel 58 constructed of formed sheet metal or the like, comprising a flat front face 59, and inwardly bent marginal edges 60–63. In the cover panels 7*a–c* shown in FIGS. 3–5, hook shaped tabs or fasteners 64 are mounted on the side edges 62 and 63 of inner panel 58, and are shaped to be received within the hanger slots 30 of vertical uprights 22*a–d*. A fabric, or other similar cover layer 65 may be attached to the exterior of inner panel 58, and drawn around the marginal edges 60–63 thereof, so as to present a neat finished exterior appearance. Adhesive or other similar fastening means may be used to attach the cover layer 65 to inner panel 58.

Figure 6:
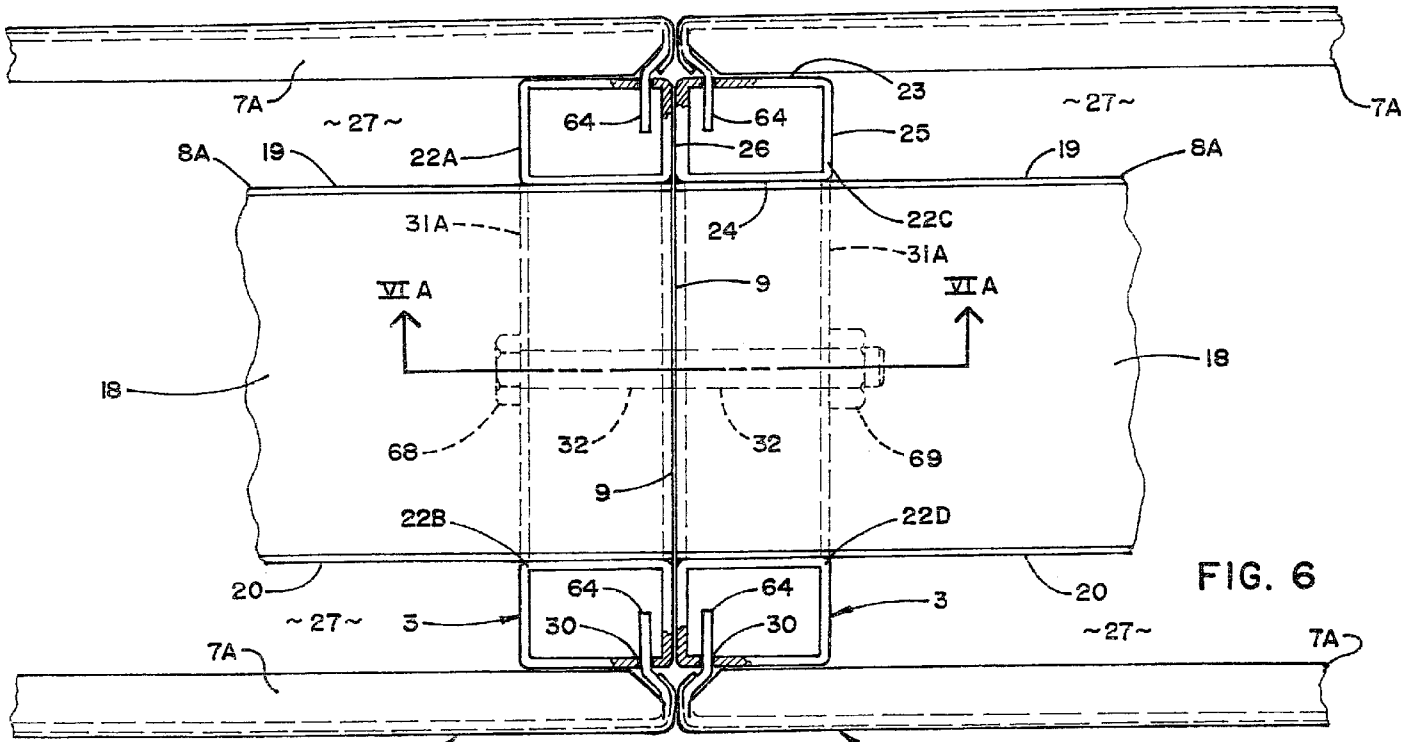
FIG. 6 is a top plan view of a pair of utility panels directly interconnected in a side-by-side relationship.
Figure 6A:
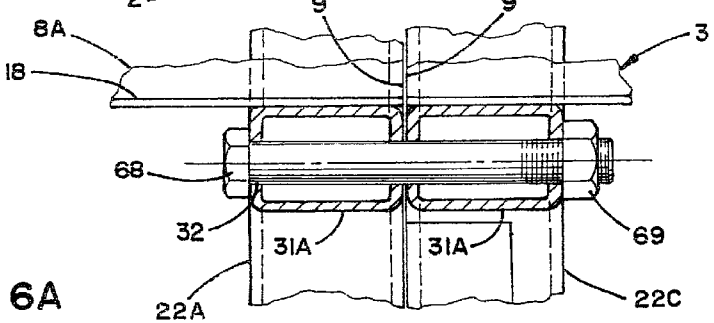
FIG. 6A is a fragmentary, vertical cross-sectional view of the directly interconnected utility panels, taken along the line VIA—VIA of FIG. 6.

Each of the cover panels 7*a–c* illustrated in FIG. 6, is shaped so that the side edges 62 and 63 are positioned substantially flush with the exterior side faces 26 of vertical uprights 22*a–d*. In this manner, when adjacent utility panels 2 are directly interconnected in a side-by-side relationship, as shown in FIGS. 6 and 6A, the side edges 60 and 61 of cover panel 7*a–c* will abut. The upper and lower edges 62 of each of the cover panels 7*a–c* are spaced apart selected distances in accordance with the spacing of utility troughs 8*a–e,* and/or location of hanging furniture articles. In the illustrated example, the upper cover panel 7*a* has a height selected such that its upper edge 60 is generally flush with the upper ends of vertical uprights 22*a–d,* while its lower edge 61 is positioned generally flush with the bottom of utility trough 8*b.* The lower cover panel 7*b* has its lower edge 61 positioned substantially coplanar with the uppermost edge of base cover 51, and its upper edge 60 positioned substantially coplanar with the top of utility trough 8*c.* Intermediate cover panel 7*c,* has its upper and lower edges 60 and 61 positioned to abut the lower edge 61 of upper panel 7*a,* and the upper edge 60 of lower panel 7*b,* respectively. In the example shown in FIG. 3, the upper edge 60 of intermediate panel 7*c* is disposed substantially coplanar with the bottom of utility trough 8*b,* and its lower edge 61 positioned substantially coplanar with the top of utility trough 8*c.* In this manner, removal of upper cover panel 7*a* provides ready access to utility troughs 8*a* and 8*b,* removal of lower cover panel 7*b* provides ready access to utility troughs 8*d* and 8*e,* and removal of intermediate cover panel 7*c* provides access to center utility trough 8*c.*

Adjacent utility panels 2 are adapted to be interconnected in a side-by-side relationship in a number of different fashions, as required by a particular installation. In the embodiment illustrated in FIGS. 6 and 6A, adjacent utility panels 2 are directly interconnected, with the exterior faces 26 of adjacent vertical uprights 22*a–d* a butting one another. The two centermost utility panels 2 illustrated in FIG. 1 are directly interconnected in this fashion. In this embodiment, through bolts 68 (FIGS. 6 & 6A) are inserted through the apertures 32 of each adjacent pair of connector brackets 31*a–c.* A nut 69 is threaded onto the free end of each bolt 68, and tightened, so that adjacent utility panels 2 are securely interconnected in the illustrated flush relationship. This type of flush interconnection can be used when it is not necessary to hang furniture articles from the utility panels 2. When utility panels 2 are interconnected in the flush relationship discussed above, the ends 9 of adjacent utility troughs 8*a–e* are aligned and in sufficiently close proximity to form a substantially continuous raceway throughout the utility panel system 1.

Alternative techniques for interconnecting adjacent utility panels 2 are illustrated in FIGS. 7–17 wherein different style panel connectors 10 are used, particularly when utility panels 2 are used as a spine to feed strings of existing partition panels, such as the illustrated partition panels 11 and 12. In the example illustrated in FIG. 1, partition panels 11 and 12 represent two different styles of existing partition panels that are presently manufactured and sold by Steelcase Inc., assignee of the present application. Partition panel 12 is a partially schematic illustration of a panel manufactured and sold by Steelcase Inc. under the "Series 9000" trademark, additional details of which are disclosed in U.S. Pat. Nos. 4,144,924 and 4,203,639, as identified in Applicant's associated Information Disclosure Statement. In general, each of the "Series 9000" partition panels 12 includes a two-piece bracket 72 mounted along both side edges thereof in which flexible hinge strips 73 are received and retained. The use of a single hinge strip 73 to interconnect adjacent "Series 9000" panels permits the 12 partition panels to be rotated with respect to one another, whereas the use of two hinge strips 73 interconnects adjacent "Series 9000" panels in a fixed in-line condition.

A different style partition panel is indicated by the reference numeral 11, and in the illustrated example, comprises a panel manufactured and sold by Steelcase Inc. under the "Valencia" trademark, additional details of which are apparent from the Applicant's associated Information Disclosure Statement. Unlike the flexible hinge connector arrangement incorporated into the "Series 9000" panel system discussed above, the ""Valencia"" panel system employs separate connector posts 75 to interconnect adjacent partition panels 11. Each "Valencia" brand partition panel has a pair of windowed brackets 76 (FIG. 14) attached to the opposite sides thereof, and the connector posts 75 have a mating tab bracket 77, which interlocks with the windowed bracket 76, as described in greater detail hereinafter. The "Valencia" connector post rigidly interconnects adjacent partition panels 11 in either an in-line, "T", or "X" configuration.

It is to be understood that while utility panel system 1 is disclosed herein for use in conjunction with Steelcase "Series 9000" and "Valencia" brand partition panels 11 and 12, it is equally applicable to other types of partition systems, including those associated with panel manufacturers other than Steelcase Inc.

Figure 7:
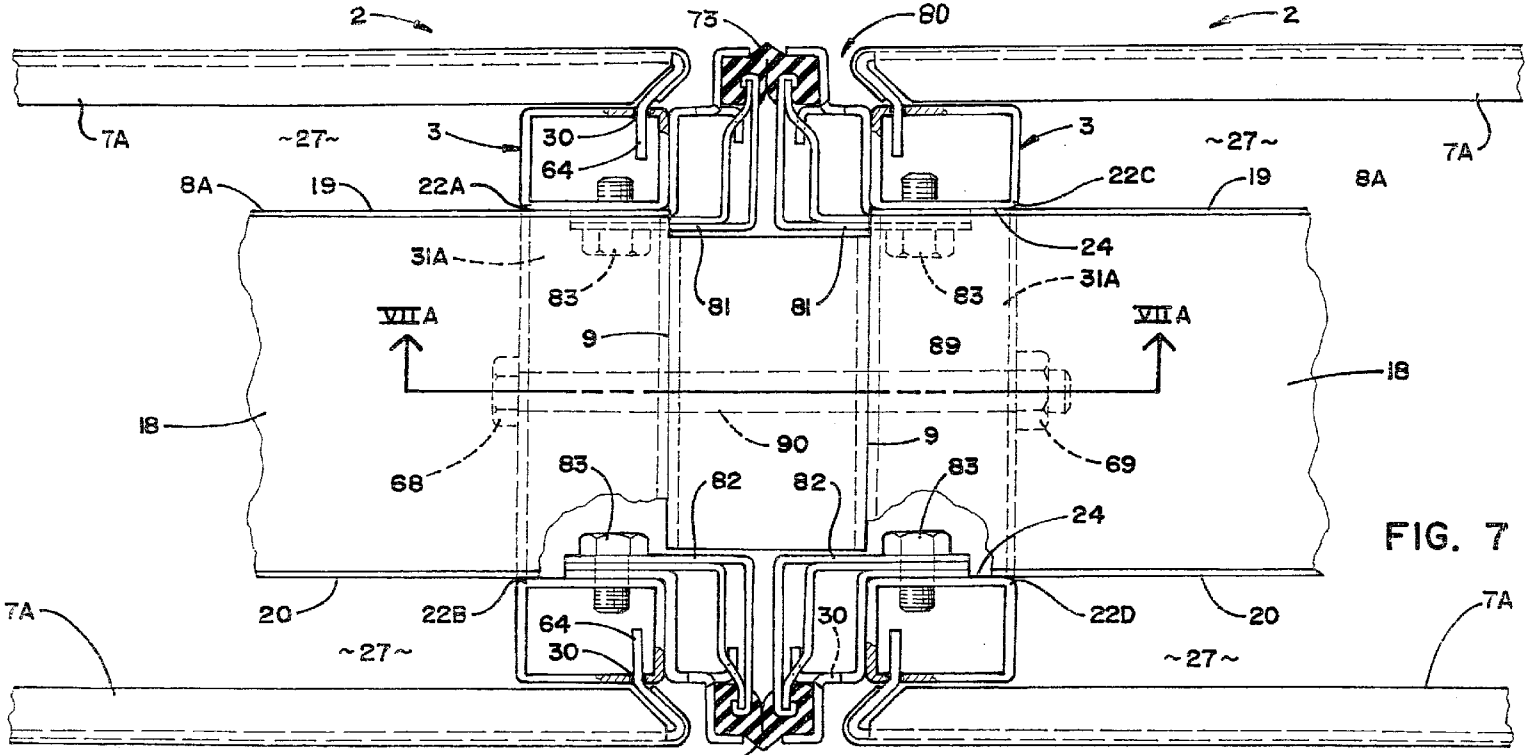
FIG. 7 is a top plan view of a pair of utility panels interconnected an in-line panel connector.
Figure 7A:
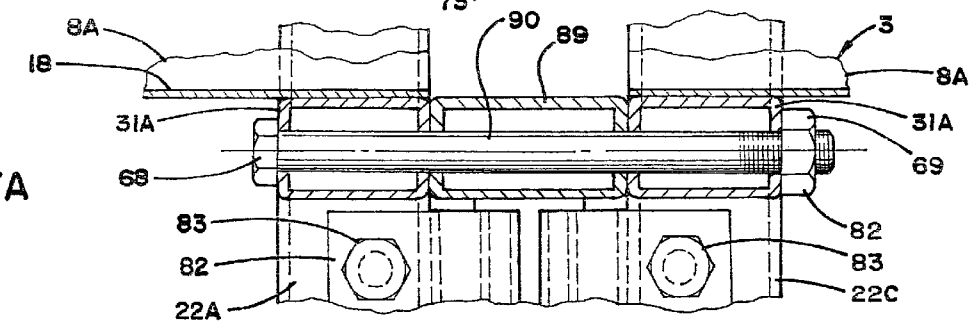
FIG. 7A is a fragmentary, vertical cross-sectional view of the utility panels and in-line panel connector, taken along the line VIIA—VIIA of FIG. 7.
Figure 10:
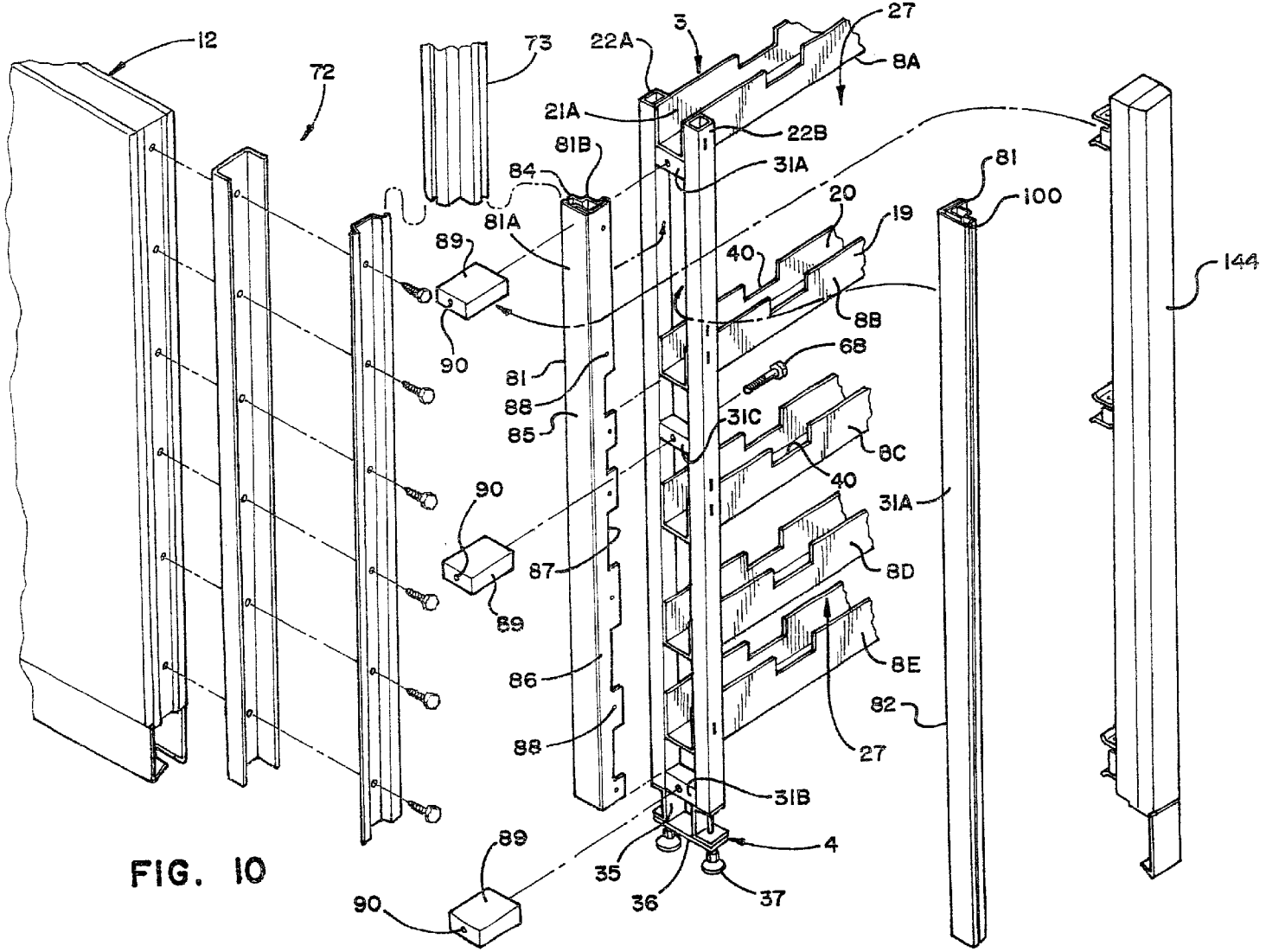
FIG. 10 is an exploded, perspective view of a utility panel and existing panel interconnected by a T-panel connector.
Figure 15:
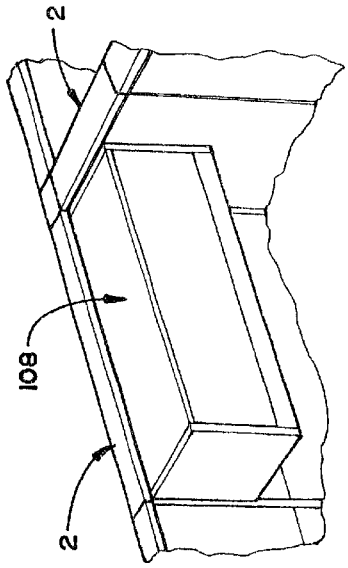
FIG. 15 is a perspective view of a storage bin mounted on a utility panel.
Figure 16:
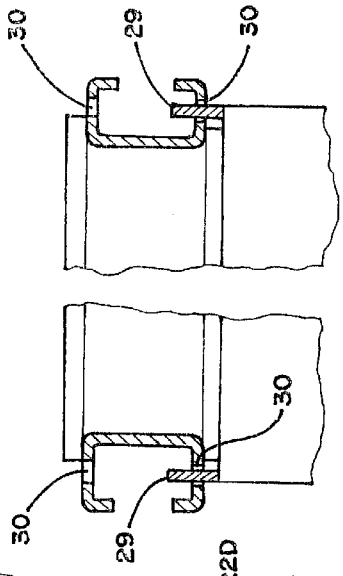
FIG. 16 is a fragmentary, cross-sectional view of the storage bin attachment to the utility panel.

The panel connector 10 illustrated in FIGS. 7 and 7A is particularly designed for interconnecting utility panels 2 that are used in conjunction with Steelcase "Series 9000" brand partition panels 12. The illustrated in-line panel connector is designated by the reference numeral 80, and in general comprises two pairs of brackets 81 and 82, which are shaped to be fastened to the rear faces 24 of vertical uprights 22*a–d* by suitable fastening means, such as the illustrated bolts 83. As best illustrated in FIG. 10, brackets 81 and 82 have a generally L-shaped top plan configuration, and are elongate, extending generally along the entire side of utility panel frame 3. Each bracket 81 and 82 has a two-part construction, with a channel 84 formed in between the outer and inner bracket halves 81*a* and 81*b* at the outwardly extending flange 85 thereof, which is shaped similar to the bracket 72 in the "Series 9000" panels so as to receive a flexible hinge 73 therein. The opposite flange 86 and bracket 84 includes cut out notches 87 in which the ends 9 of utility troughs 8*a–e* are received, and apertures 88 through which the fastener bolts 83 extend to mount the brackets 81 and 82 to the vertical uprights 22*a–d.* Three spacer blocks 89 are also provided, and are positioned between the three connector brackets 31*a–c* of panel frame 3. Each connector block 89 includes a longitudinally extending aperture 90 in which through bolts 68 are received, as best illustrated in FIGS. 7 and 7A. Connector blocks 89 fill in the space or gap formed between the ends 9 of adjacent utility troughs 8*a–e,* so that the raceway 21 has a substantially continuous construction. Two flexible hinges 73 (FIG. 7) interconnect both pairs of brackets 81 and 82, and thereby create a visual appearance very similar to that of the "Series 9000" panels 12 to maintain a uniform design theme.

Figures 8, 9:
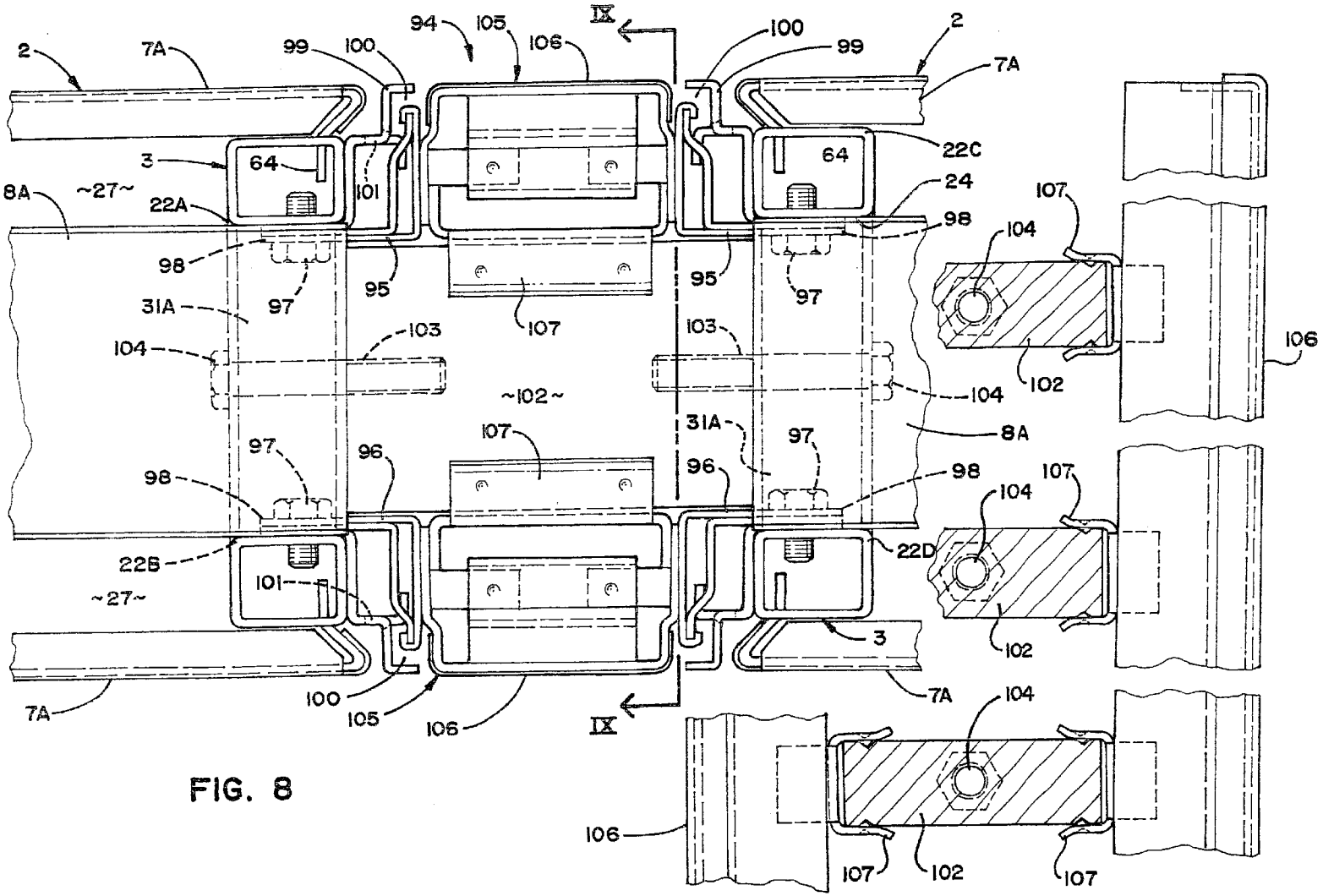
FIG. 8 is a top plan view of a pair of utility panels interconnected by a spacer panel connector.
FIG. 9 is a fragmentary, vertical cross-sectional view of the utility panels and spacer panel connector, taken along the line IX—IX of FIG. 8.

An in-line spacer connector 94 is illustrated in FIGS. 8 and 9, and is somewhat similar to the in-line connector 80 described above. Spacer connector 94 is also adapted to be used in conjunction with utility panels 2 that are to be interconnected with "Series 9000" panels 12, and includes two pairs of brackets 95 and 96, which are substantially identical to the brackets 81 and 82 of in-line connector 80. Bolts 97 attach the interior flanges 98 of brackets 95 and 96 to the rear faces 24 of vertical uprights 22*a–d.* The exterior flanges 99 of brackets 95 and 96 each carry a channel 100 in which one of the side beads of flexible hinge 73 is received, and a series of slots 101 in which furniture articles, such as the binder bin 108 illustrated in FIG. 15, may be hung. Three connector blocks 102, somewhat longer than connector blocks 89, are provided to span the distance between the three connector brackets 31*a–c* of adjacent utility panels 2. Each connector block 102 includes two threaded apertures 103 in which mounting bolts 104 are threadedly secured. A pair of filler posts 105 are positioned in between brackets 95 and 96, and include a generally flat outer surface 106 designed to mate aesthetically with the exterior appearance of utility panels 2. Each filler post 105 includes a plurality of inwardly facing, U-shaped clips 107 attached to the interior face thereof, in which the side edges of connector blocks 102 are received to secure filler post 105 in place. In the illustrated example, U-shaped clips 107 have a snap lock detent which mates with associated recesses in the connector blocks 102 to securely, yet removably retain the filler posts 105 in place.

Figure 11:
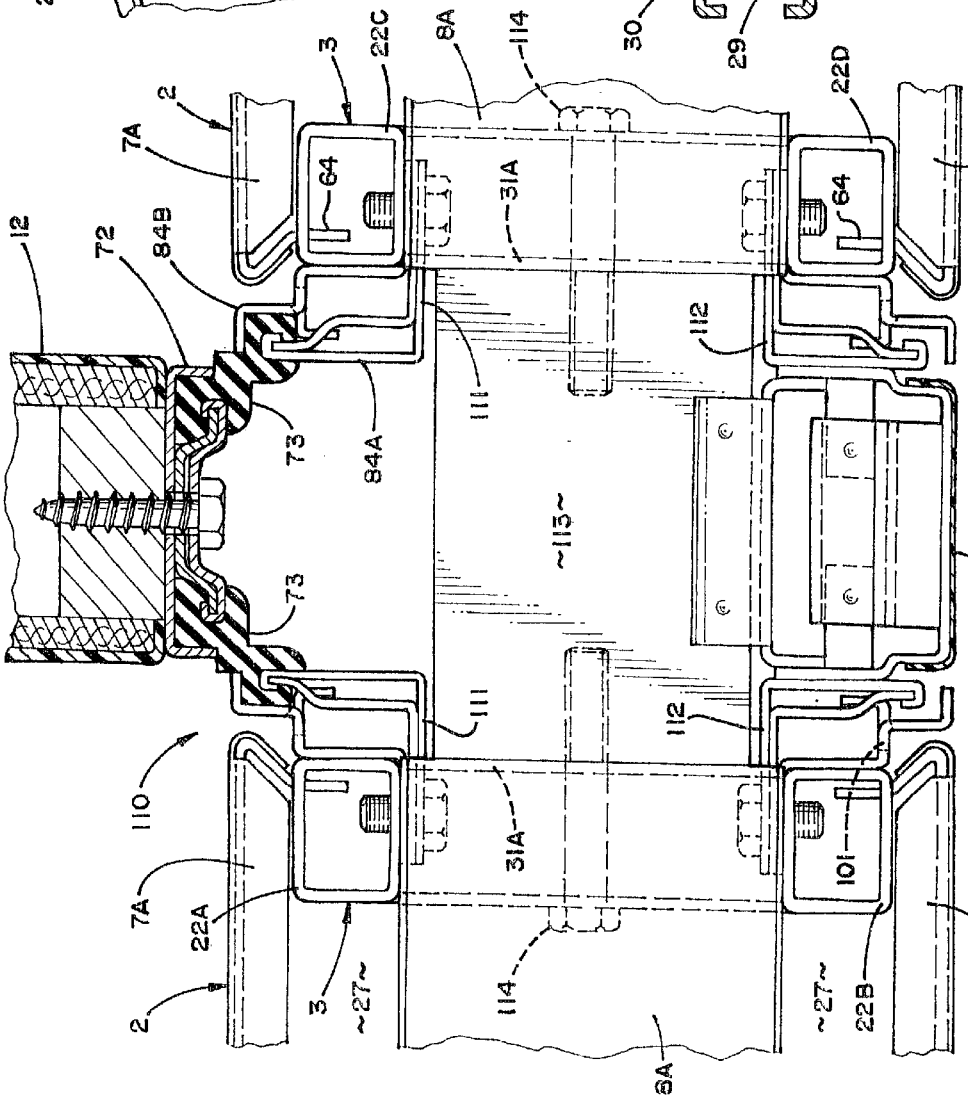
FIG. 11 is a top plan view of a pair of utility panels interconnected by a T-panel connector.

A T-panel connector 110 is illustrated in FIG. 11, and incorporates parts identical to those already described hereinabove. More specifically, T-panel connector 110 includes two pairs of brackets 111 and 112, which are substantially identical to previously described brackets 81–82 and 95–96. Three connector blocks 113, identical to connector blocks 102, extend between the three connector brackets 31*a–c* of adjacent panel frames 3, and are securely interconnected thereto by bolts 114. A single filler post 115, identical to one of the filler posts 105, is mounted on one side of the adjacent utility panels 2, and a pair of flexible hinges 73 attach a standard "Series 9000" panel 12 to the bracket pair 111 on the opposite side of utility panels 2.

Figure 12:
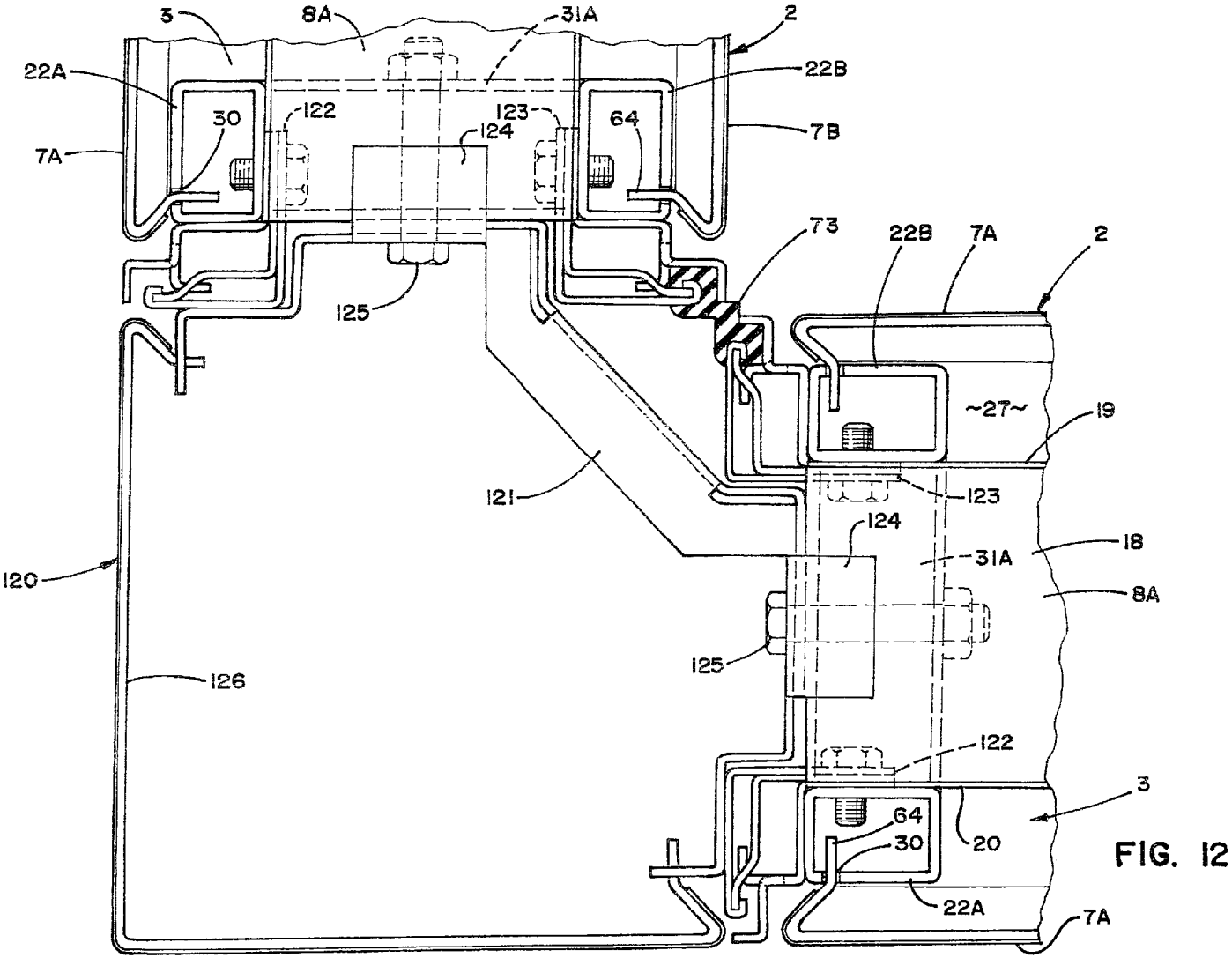
FIG. 12 is a top plan view of a pair of utility panels interconnected by an L-panel connector.

An L-panel connector 120 is illustrated in FIG. 12, and is adapted to interconnect two adjacent utility panels 2 in a 90-degree configuration. L-panel connector 120 includes a generally L-shaped frame 121 with two pairs of brackets 122 and 123, similar to brackets 81 and 82 attached to the opposite flanges thereof. U-shaped clips 124 are received over the connector brackets 31*a–c* of adjacent vertical uprights 22*a–e,* and include bolts 125 to securely interconnect the same. A single, flexible hinge 73 interconnects the bracket pair 123 on the interior side of the utility panels 2, while an L-shaped cover 126 extends between and encloses the free ends of connector frame 121.

Figure 14:
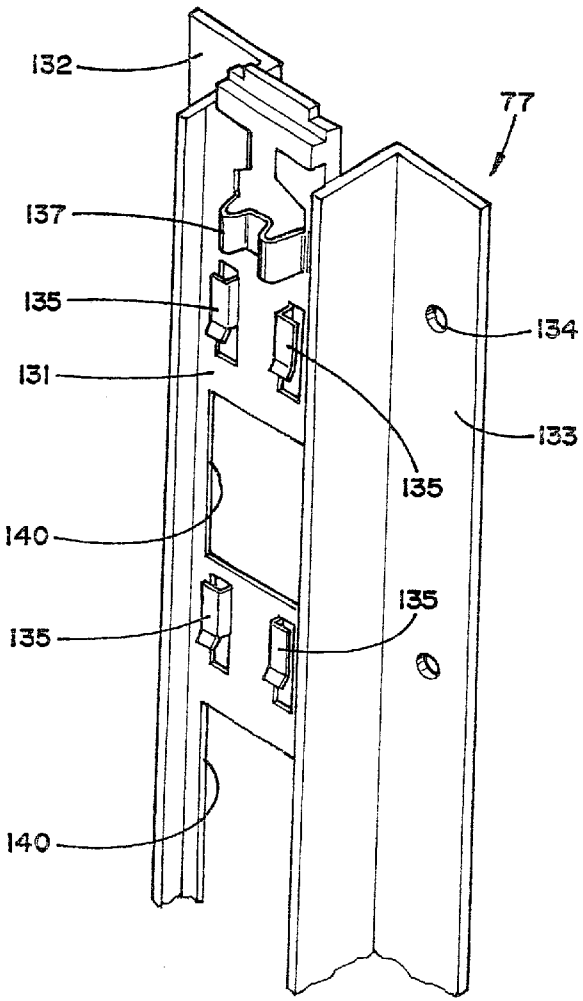
FIG. 14 is a perspective view of a panel connector adapted for use in conjunction with the partition panel illustrated in FIG. 13.
Figure 13:
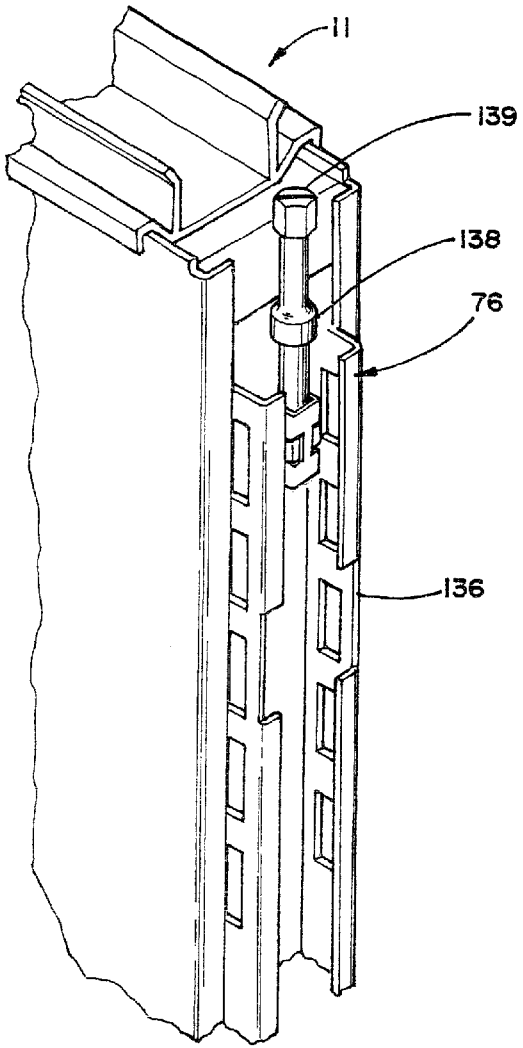
FIG. 13 is a fragmentary, perspective view of a second style existing partition panel.

An alternative T-panel connector 77 is illustrated in FIGS. 13 and 14, and is particularly adapted for interconnecting two utility panels 2 with a music-flat. Valencia" style partition panel 11 in a T-configuration. The "Valencia" T-panel connector 77 comprises a central fastener web 131, having a pair of L-shaped channels 132 and 133 fixedly interconnected along opposite sides thereof. The connector channels 132 and 133 include fastener apertures 134 through which fasteners are inserted to attach the connector 77 to the rearward faces 24 of adjacent vertical uprights 22*a* & *c* and 22*b* & *d* respectively, in a fashion substantially identical to the attachment of connector 80, as described above. In a T-configuration, a cover panel (not shown) is positioned over the connector 77 that is not attached to a partition panel 11. The web 131 of connector 130 carries outwardly protruding tabs 135 which are matingly received through windows 136 in the connector bracket 76 of an adjacent "Valencia" panel 11. A collar 137 is mounted at the upper end of web 131, and is engagingly received by an enlarged portion 138 of a lock bolt 139 on "Valencia" panel 12. Windows 140 are formed through the web 131 of connector 77, and are positioned for alignment with the utility troughs 8*a–e* of an associated utility panel 2, such that the utilities, such as wires, and the like can be routed from the utility troughs 8*a–e* of the associated utility panel 2 through bracket windows 140, and into the interior of "Valencia" panel 12.

Figure 2:
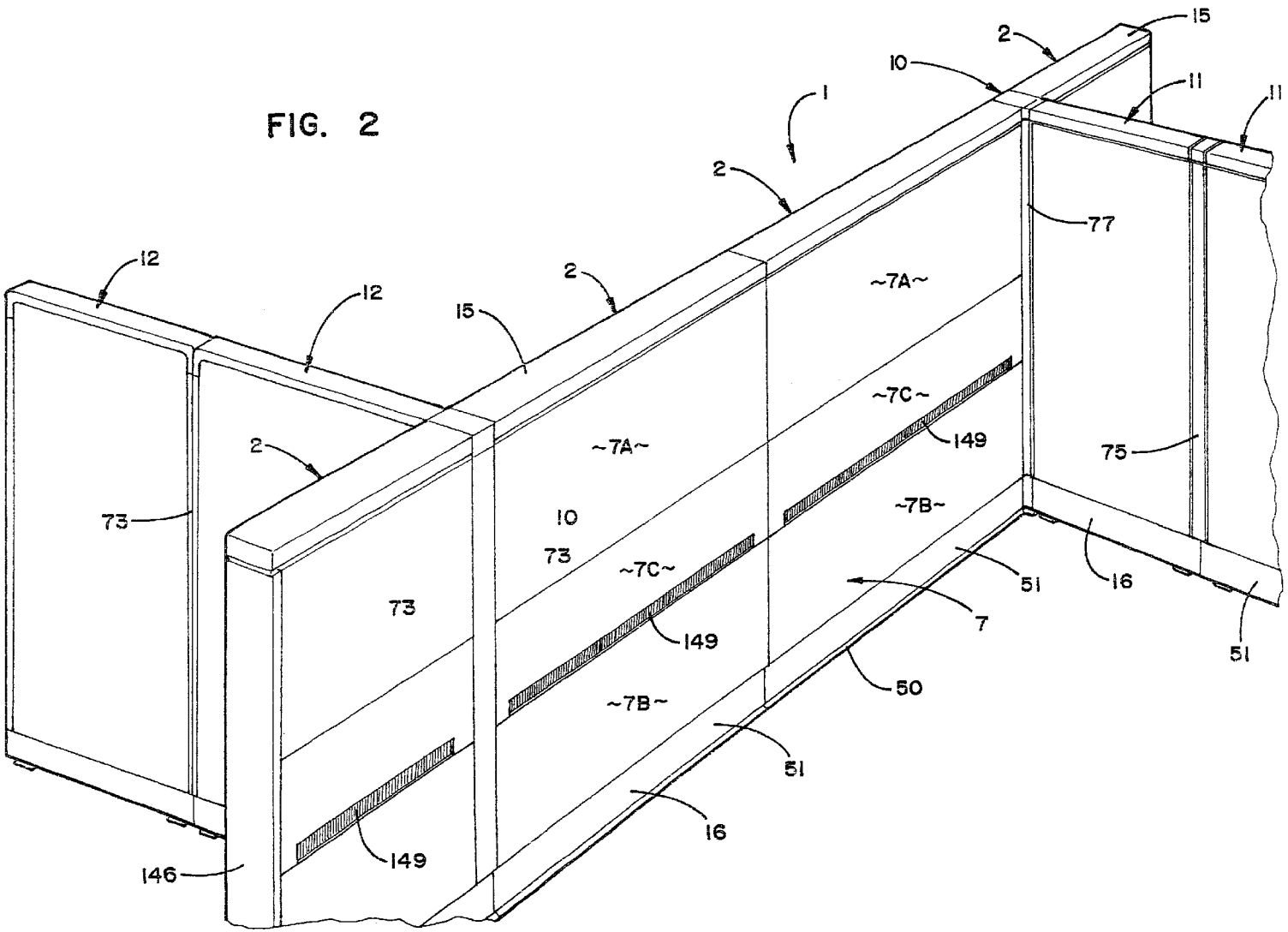
FIG. 2 is a perspective view of the utility panel system illustrated in FIG. 2, wherein the utility panels, and existing partition panels are shown in a fully assembled condition.
Figure 3:
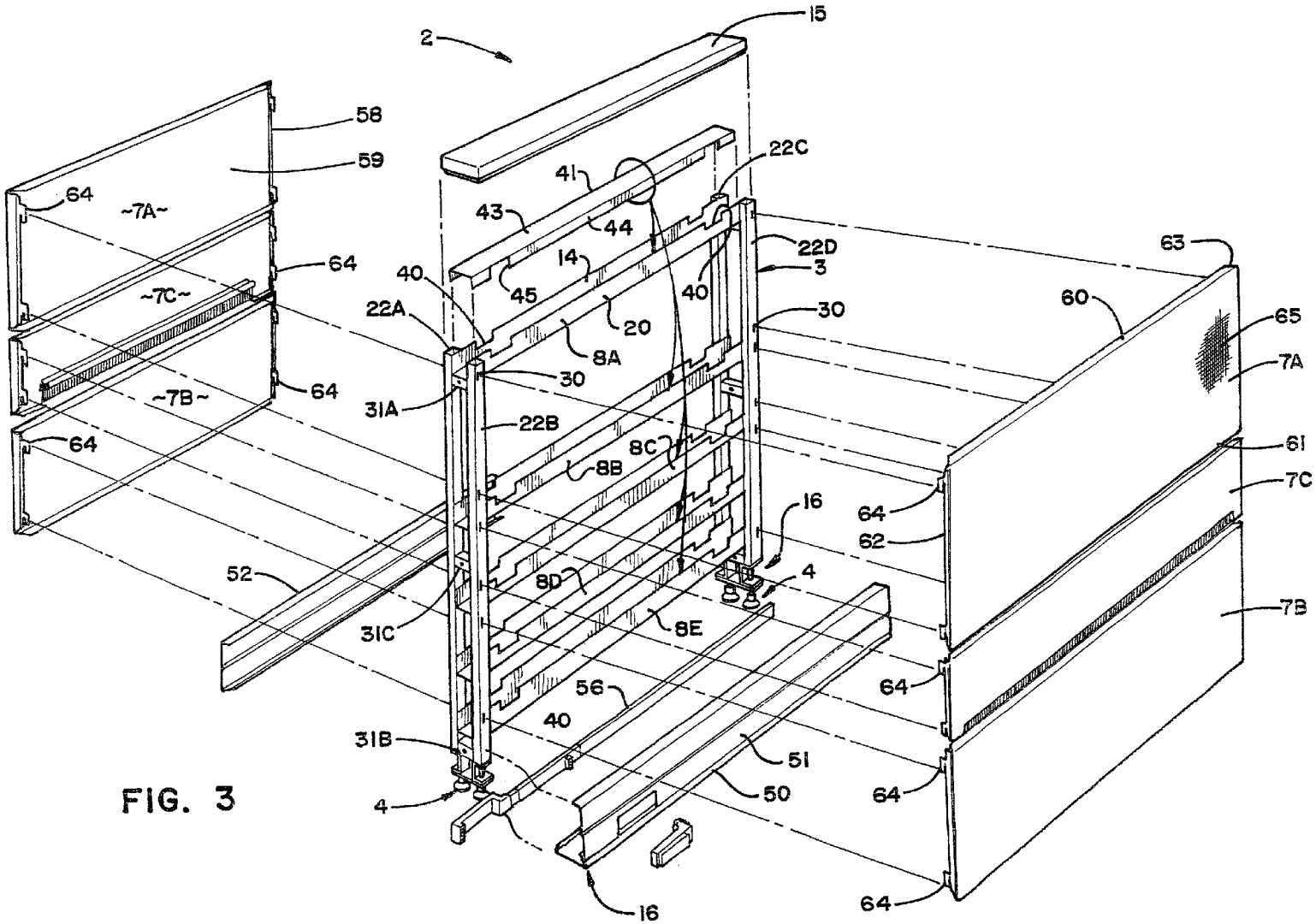
FIG. 3 is an exploded, perspective view of a utility panel.

As best illustrated in FIGS. 1 and 2, utility panels 2 are particularly adapted to be interconnected in an in-line relationship using either a flush type connection (FIGS. 6–6A), or one of the panel connectors 10 to form a central spine from which strings of partition panels 11 and 12 T-off in a 90 degree orientation. The additional utility carrying capability of the utility panels 2 thereby greatly increases the effective life and operation of the existing panels 11 and 12 by adapting them for use in electrically intensive workstations. Also, the fact that different panel connectors 10 can be attached to the same utility panel 2, lends universal functionality to the utility panel system 2 and adapts the same for use with a wide variety of different types of partition systems. The different panel connectors 10 not only account for the different fastening techniques used to interconnect various partition panels, but they also replicate the outward appearance of the particular panel system, so that the utility panels 2 blend in visually as well as functionally. Superior distribution and management of communications, signal cabling and electrical power, network connections, as well as HVAC is also achieved by permitting the utility panels 2 to carry the major burden or load of the utilities.

Figure 17:
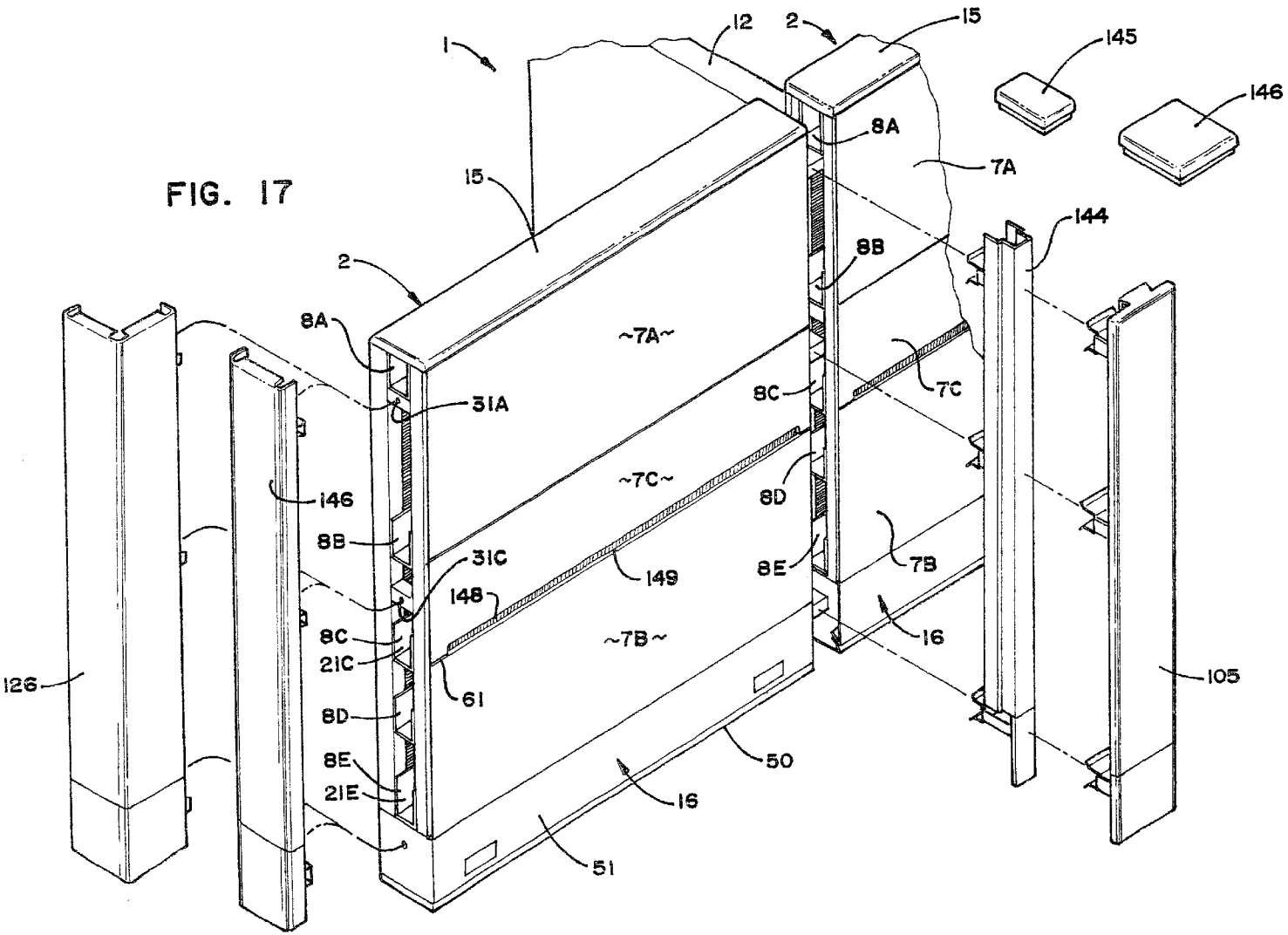
FIG. 17 is an exploded perspective view of a pair of utility panels interconnected with a partition panel by a T-panel connector.
Figures 18, 19, 20, 21:
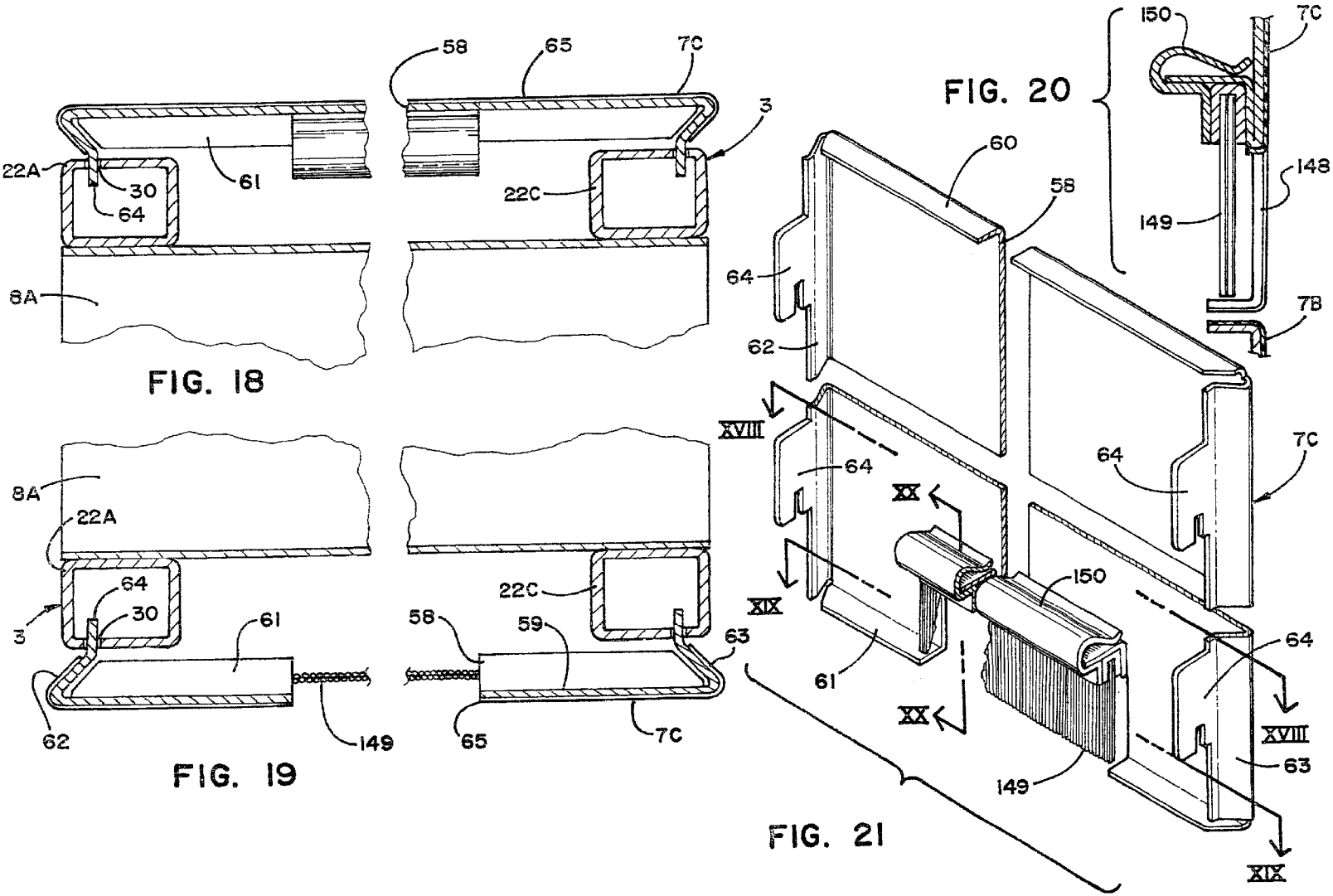
FIG. 18 is a fragmentary, horizontal cross-sectional view of the utility panel, taken along the line XVIII—XVIII of FIG. 21.
FIG. 19 is a fragmentary, horizontal cross-sectional view of the utility panel, taken along the line XIX—XIX of FIG. 21.
FIG. 20 is an enlarged, fragmentary, vertical cross-sectional view of the utility panel, taken along the line XX—XX of FIG. 21.
FIG. 21 is a fragmentary, perspective view of a removable cover panel for the utility panel.

FIG. 17 illustrates a pair of utility panels 2 interconnected with a "Series 9000" panel 12 in a "T" configuration. An alternative filler post 144 is illustrated for use in conjunction with thinner partition panels, as well as an associated top cap 145 to enclose the upper portion of the Joint. A standard style top can 146 is also illustrated for use in conjunction with filler post 105. An end cap 146 is provided to cover the end of utility panel 2 in an end-of-run condition, and has a construction generally similar to filler post 105. The intermediate cover panel 7*c* illustrated in FIG. 17 includes a flexible accessway disposed along the lower edge 61 thereof. In the illustrated example, the lower edge 61 of cover panel 7*b* includes an elongate notch 148 which is selectively closed by a flexible strip 149, in nature of a brush or bristle, which is mounted immediately behind notch 148 by a clip 150 (FIG. 21). Flexible strip 149 permits wires to be easily drawn out from utility trough 8*c,* while maintaining a neat, closed appearance.

Figure 22:
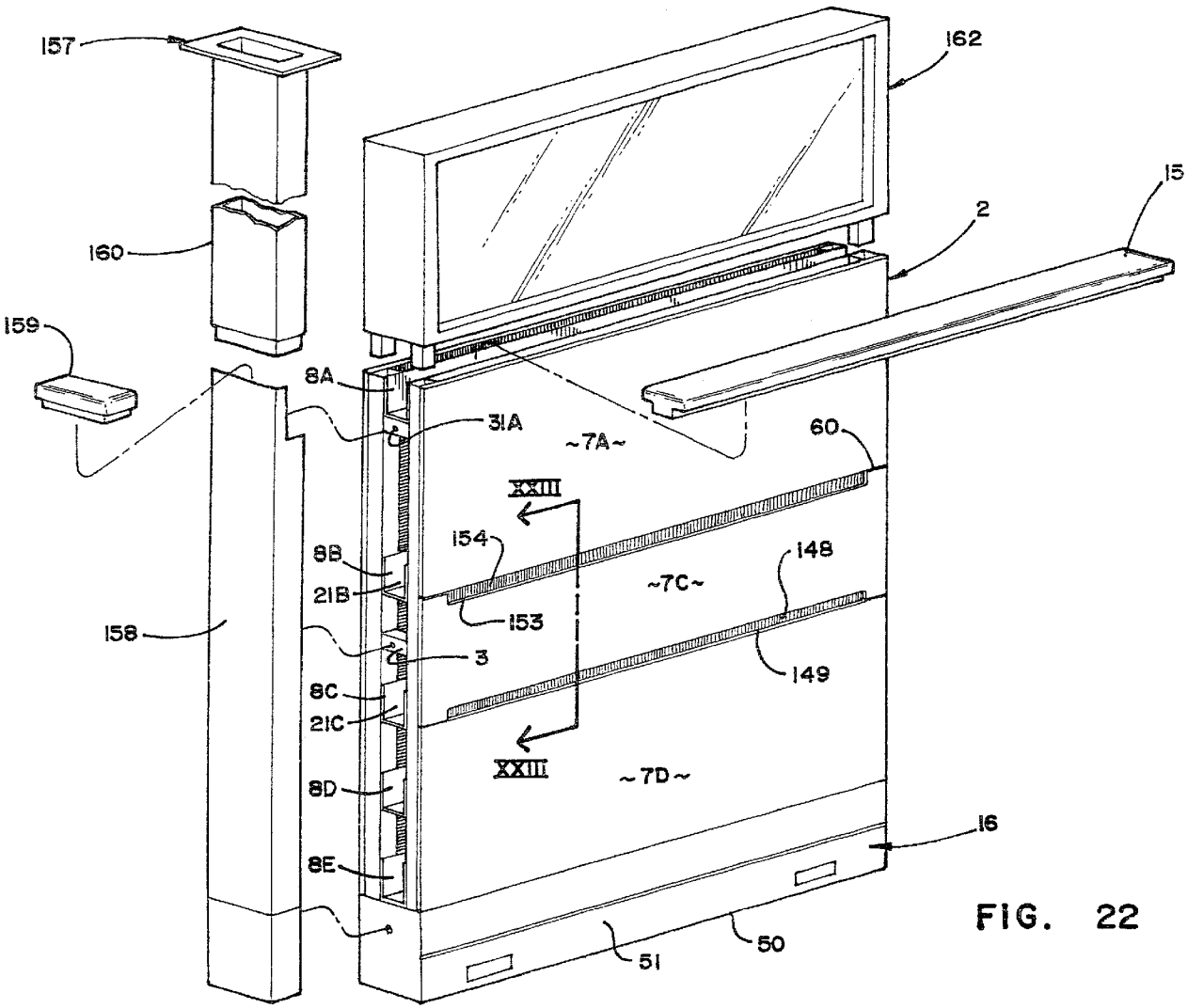
FIG. 22 is an exploded, perspective view of another embodiment of the utility panel.
Figure 24:
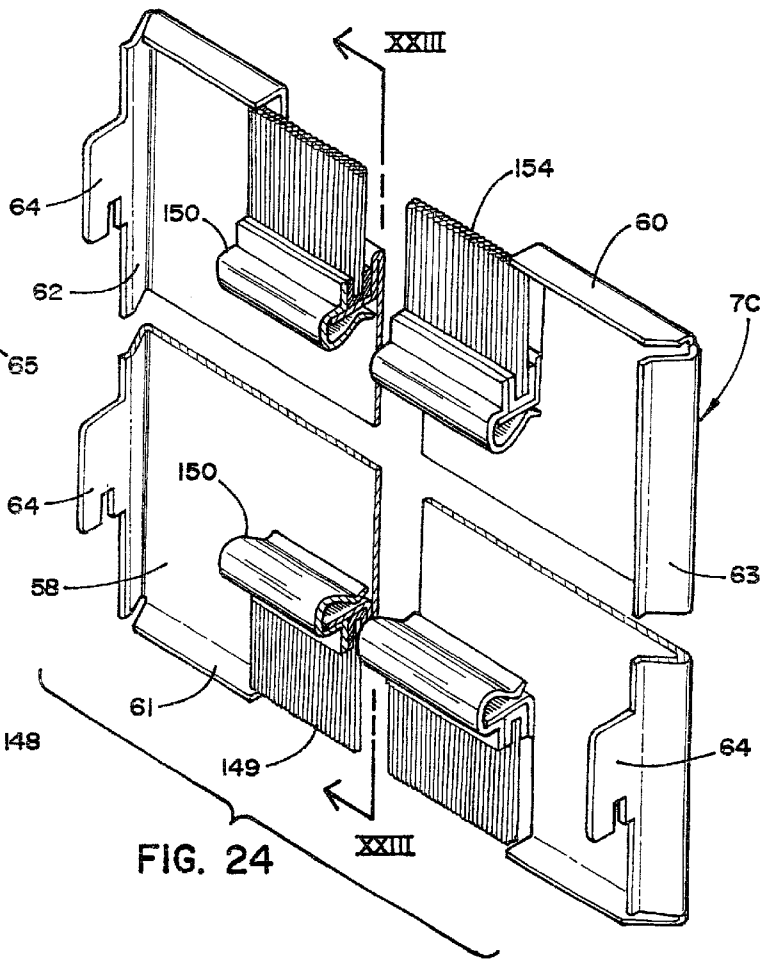
FIG. 24 is a fragmentary, perspective view of the center cover panel illustrated in FIG. 22.
Figure 23:
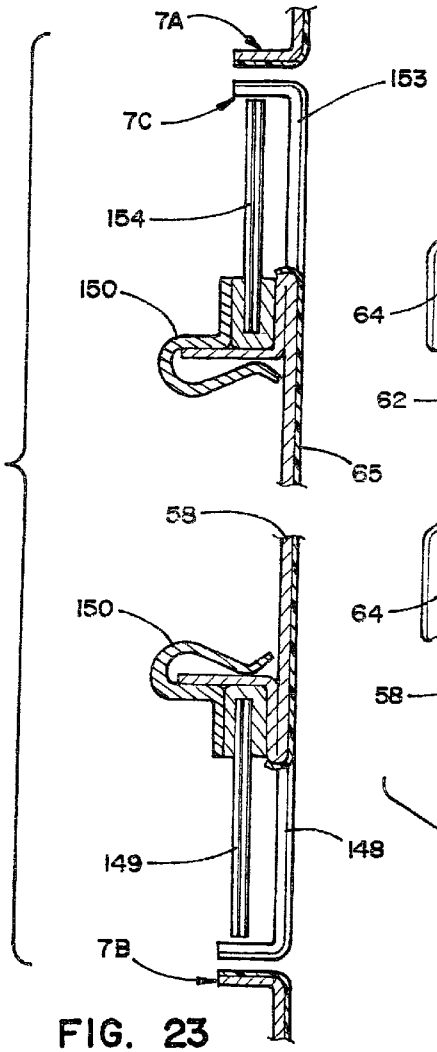
FIG. 23 is a fragmentary, vertical cross-sectional view of a center cover panel portion of the utility panel illustrated in FIG. 22, taken along the line XXIII—XXIII of FIG. 22.

As best illustrated in FIG. 22, intermediate cover panels 7*c* may also have a second notch 153 and associated flexible strip 154 disposed along the upper edge 60 thereof. In this fashion, wires and/or other utilities can be easily drawn from utility trough 7*b* through the upper notch 153 and associated flexible strip 154.

Also illustrated in FIG. 22 is an optional top power-in channel assembly 157, which includes an end channel 158 that mounts with bolts (not shown) along one side of utility panel 2, and includes a closure cap 159, or an alternative top power-in extender tube 160. The utility panel 2 illustrated in FIG. 22 also includes an alternative top panel assembly or clerestory 162, which mounts to the top of utility panel 2, and can be used to extend the overall height of the utility panel.

Figure 25:
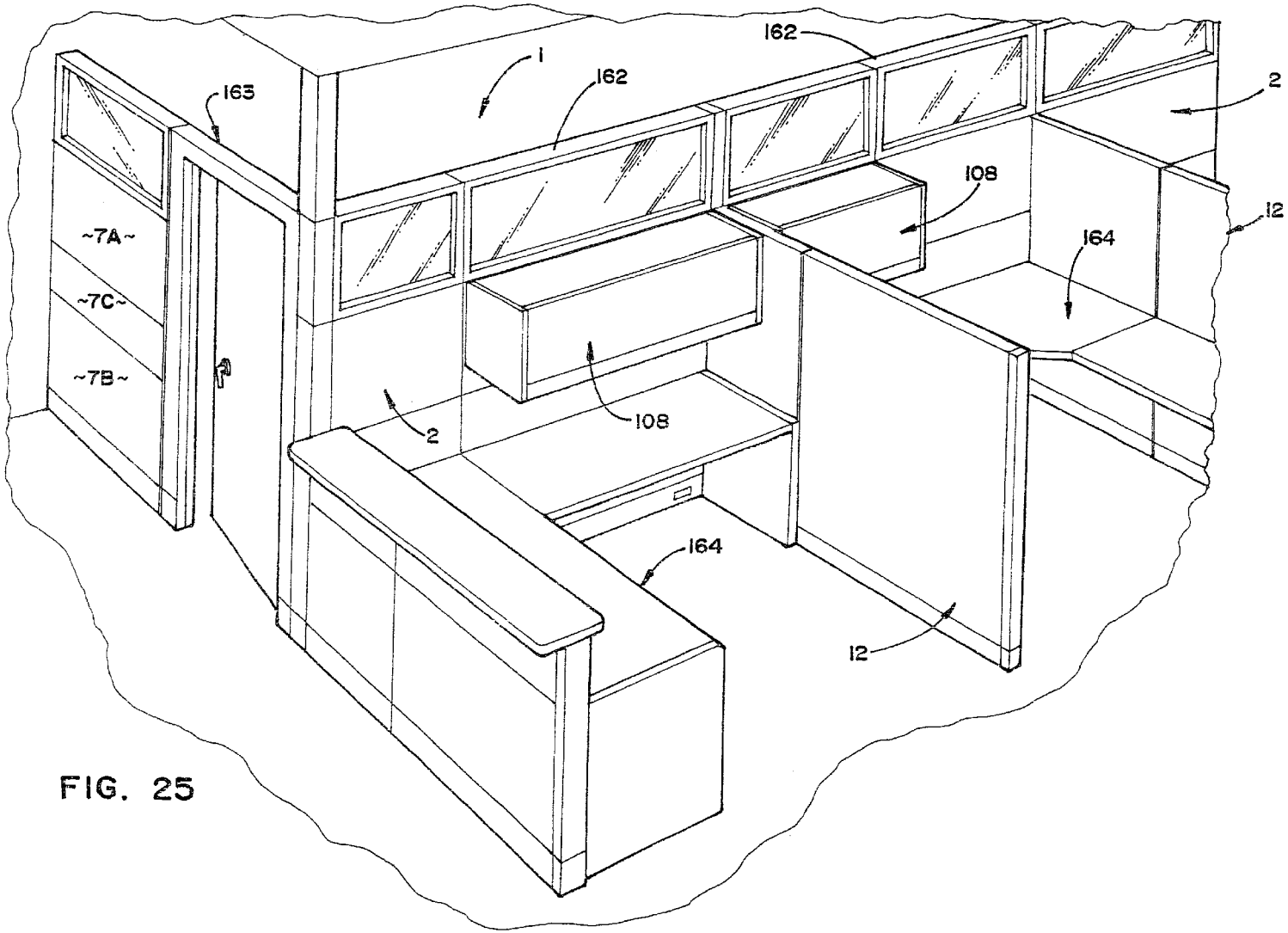
FIG. 25 is a perspective view of a combination panel system incorporating the present invention.

FIG. 25 illustrates a combination of utility panels 2 and "Series 9000" panels 12 that includes a mating door frame 163, hanging binder bins 108, and freestanding furniture 164.

FIGS. 26–34 illustrate yet another embodiment of the present invention, wherein utility panels 2' are arranged in a spine configuration with different height "Series 9000" partition panels 12'. Since the alternative utility panel arrangement 1' is similar to the previously described utility panel system 1, similar parts appearing in FIGS. 1–25 and FIGS. 26–34 respectively are represented by the same, corresponding reference numeral, except for the prime suffix in the numerals of the latter.

Figure 26:
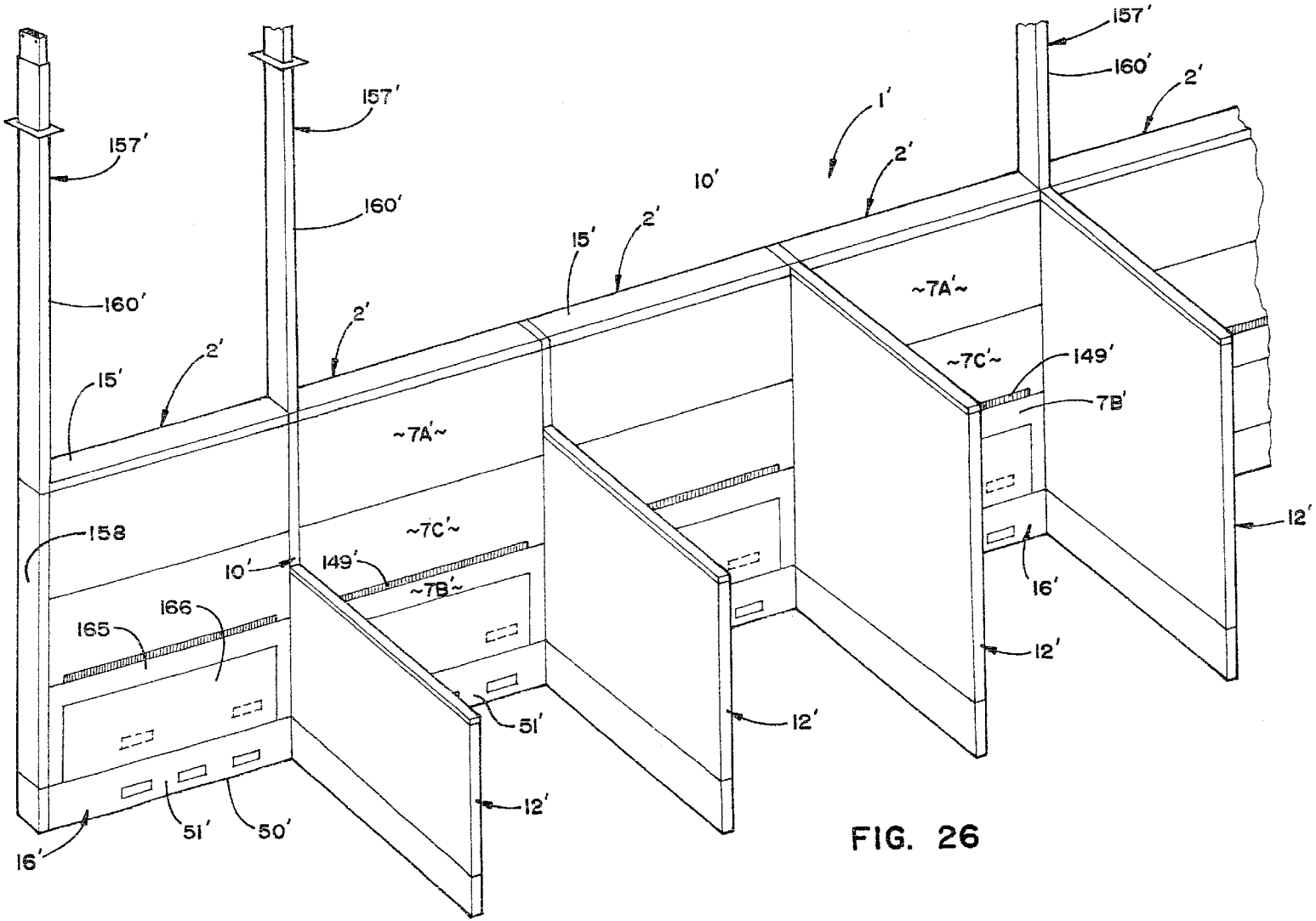
FIG. 26 is a perspective view of yet another embodiment of the present invention.
Figure 26A:
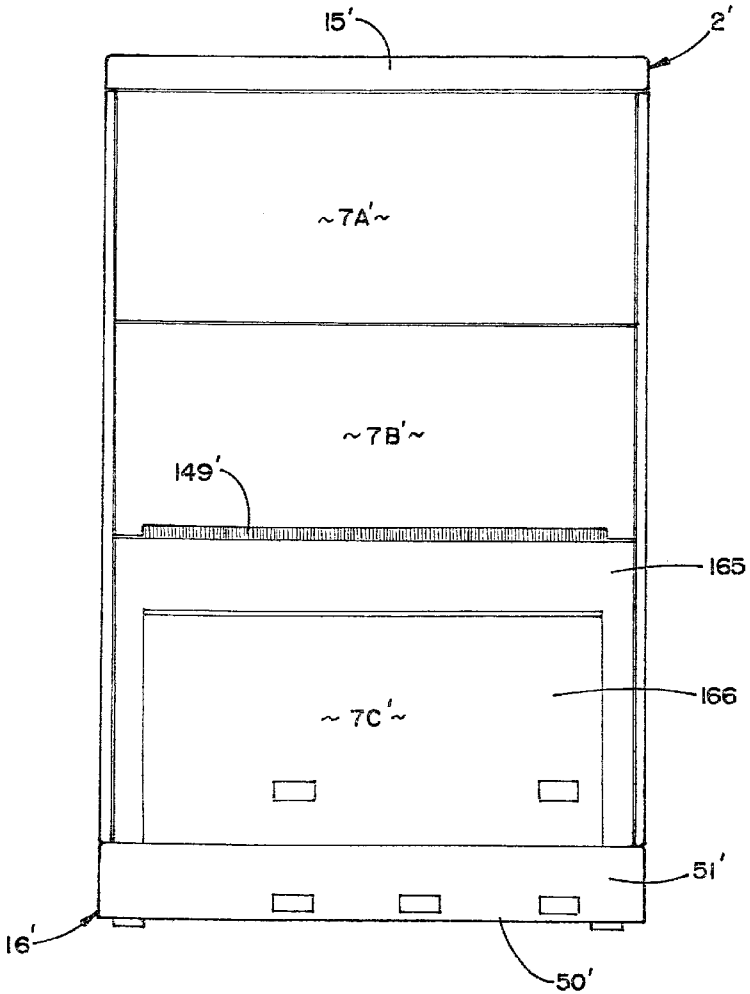
FIG. 26A is a front elevational view of the FIG. 26 embodiment of the present invention.

In utility panel system 1', adjacent utility panels 2' are arranged in an in-line spine configuration, with "Series 9000" panel connected thereto by T-connectors 110'. As best illustrated in FIGS. 26 and 26A, the lower cover panels 7*b*' of utility panels 2' have a two-part construction, comprising an outer cover panel 165, having an inverted U-shaped front elevational configuration, and an inner cover panel 166 mounted within the outer cover panel 165. Both cover panels 165 and 166 are detachably connected with the panel frame 3', and can be independently removed therefrom. Inner cover panel 166 is shaped such that it can be removed from panel frame 3', even when a worksurface is hung in place on utility panel 2'. This arrangement permits quick and easy rearrangement of utilities within utility panel 2'. The opposite, or aisle side (not shown) of utility panel 2', preferably has three plain cover panels 7', similar to the cover panels 7*a–c* illustrated in FIG. 3.

With reference to FIG. 26, the illustrated top power-in assembly 157' includes a separate, enclosed power raceway 177 which extends downwardly through extender 160' and end cap 158' into the base 16' of the associated utility panel 2' to provide electrical power to the system. A pair of top cable-in assemblies 178 are provided on two other utility panels 2' to route cabling throughout utility panel system 1'.

Figure 28:
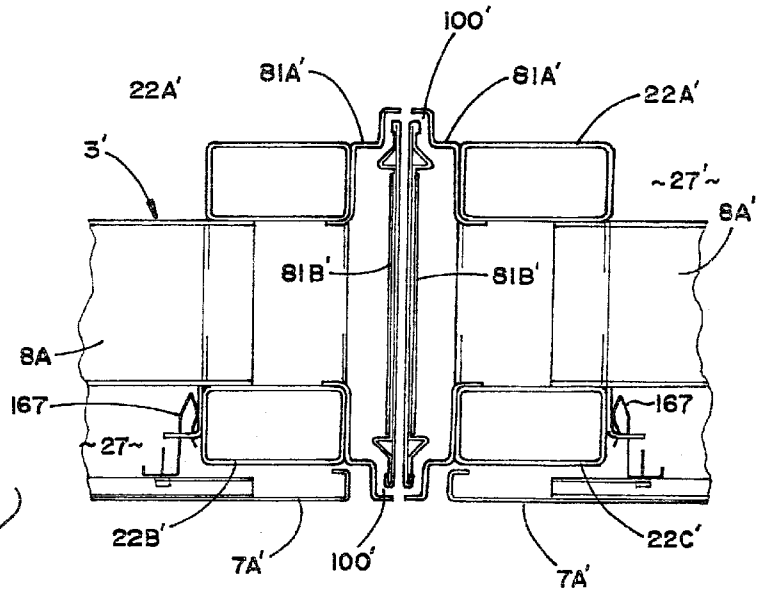
FIG. 28 is a fragmentary, horizontal cross-sectional view of the utility panels illustrated in FIGS. 26 and 27.
Figure 27:
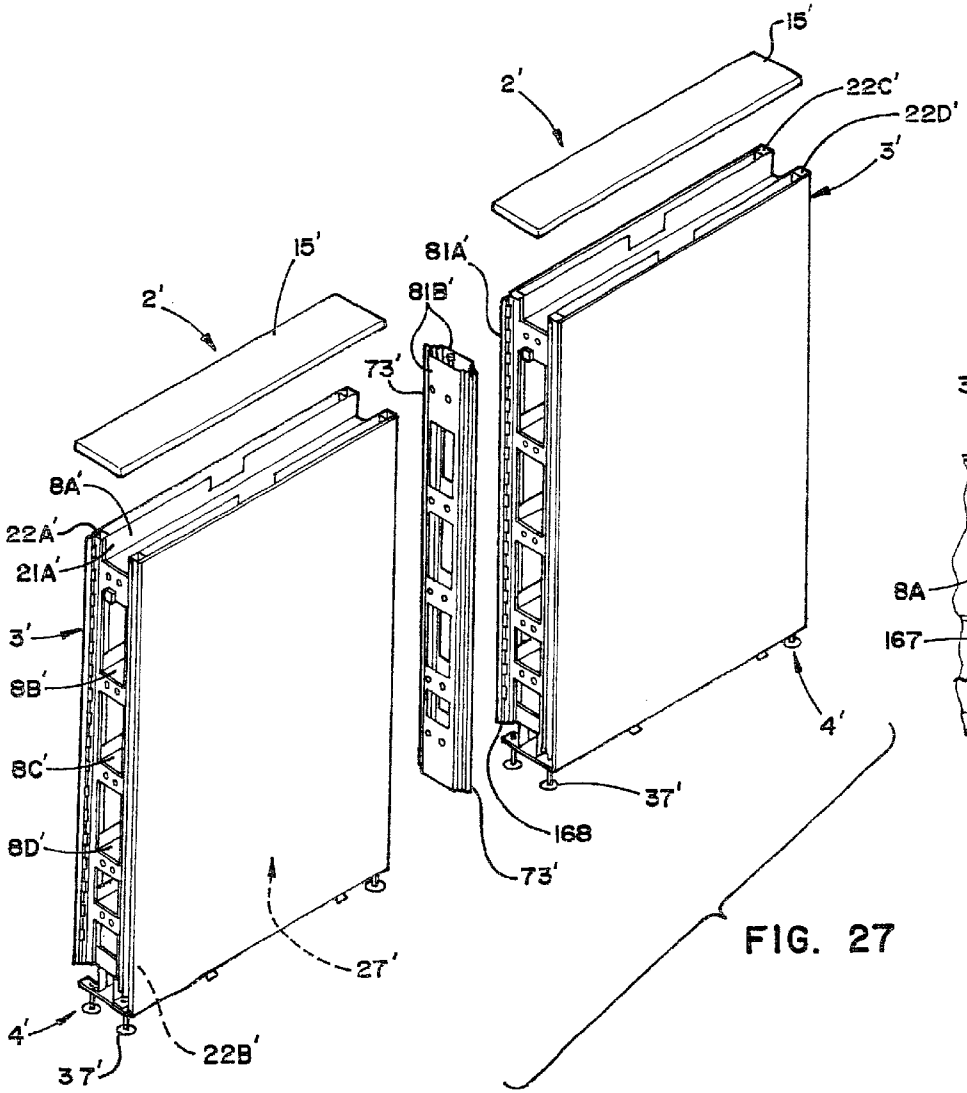
FIG. 27 is an exploded, perspective view of the FIG. 26 embodiment of the present invention, wherein adjacent utility panels are interconnected by a hinged, in-line panel connector.
Figure 29:
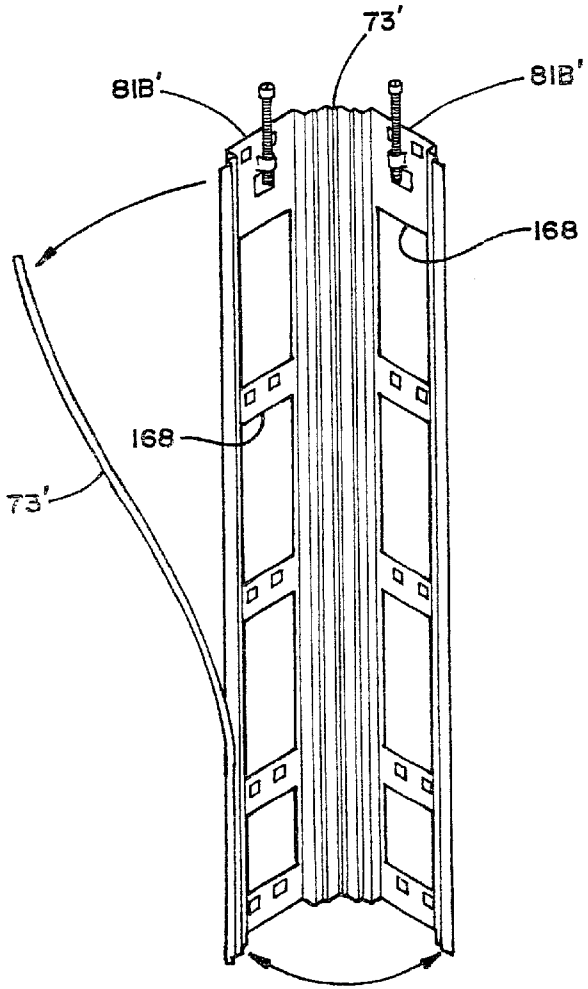
FIG. 29 is a perspective view of the hinged, in-line panel connector illustrated in FIGS. 26–28.

As best illustrated in FIGS. 27–29, in utility panel 2', the pairs of connector brackets 81' and 82' are formed in one-piece (hereinafter designated 81') with the inner halves 81*a*" of the brackets welded to the vertical uprights 22*a'–d*' of panel frame 3'. The exterior portions 81*b*' of brackets 81' are bolted to the interior portions 81*a*' thereof, and are in turn interconnected by a pair of flexible hinges 73'. Connector brackets 81' include a plurality of windows 168 in both halves arranged to be aligned with the utility troughs 8*a'–e*'. Cover panels 7' are attached to the associated panel frames 3' with spring clips 167 (FIG. 28), which permit removal of the cover panels 7' with a direct horizontal motion, thereby eliminating the need for clearance at the top and/or bottom of the cover panel for removal purposes.

Figure 30:
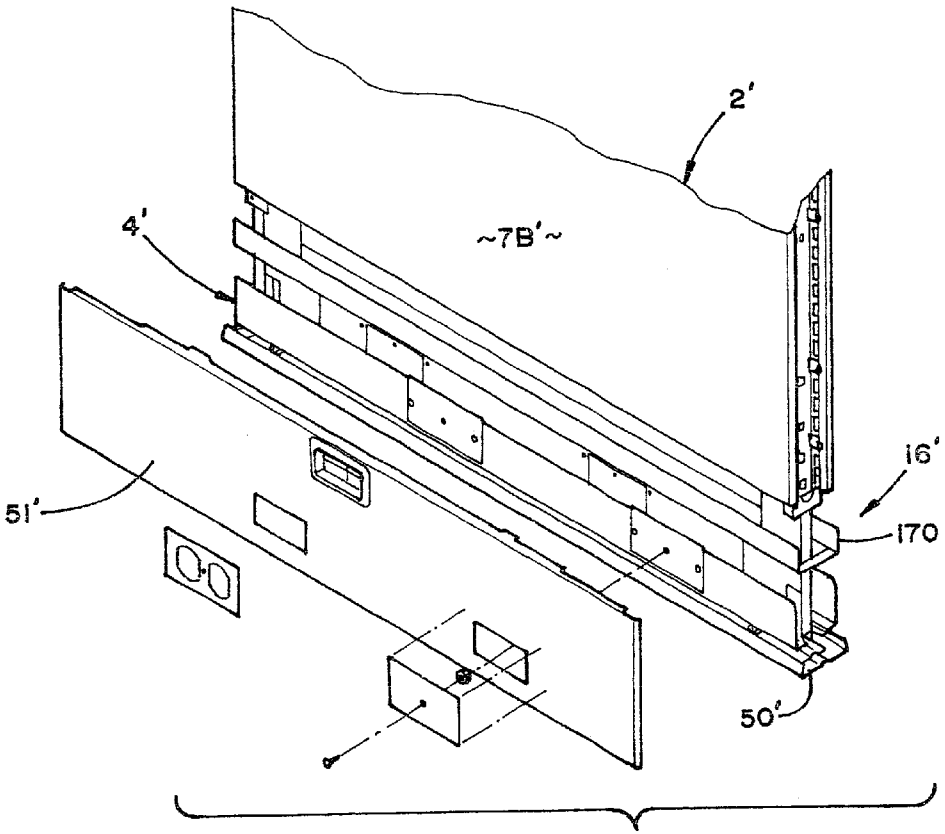
FIG. 30 is an exploded fragmentary perspective view of the utility panel illustrated in FIGS. 26–27.

As best illustrated in FIG. 30, the base assembly 16' of utility panel 2' is fully enclosed, and includes a bottom tray 170 enclosed by base cover panels 51' and 52'. Also, the utility troughs 8*a'–e*' (FIG. 27) of utility panel 2' are preferably spaced more than six inches apart to meet high level security requirements, especially with respect to eavesdropping, and other similar shielding problems.

Figure 32:
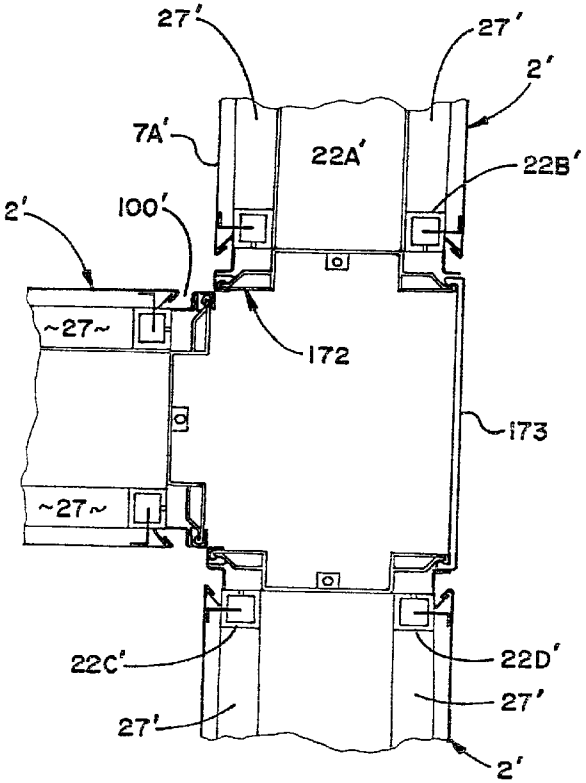
FIG. 32 is a fragmentary, horizontal cross-sectional view of the T-panel connector illustrated in FIG. 31.
Figure 31:
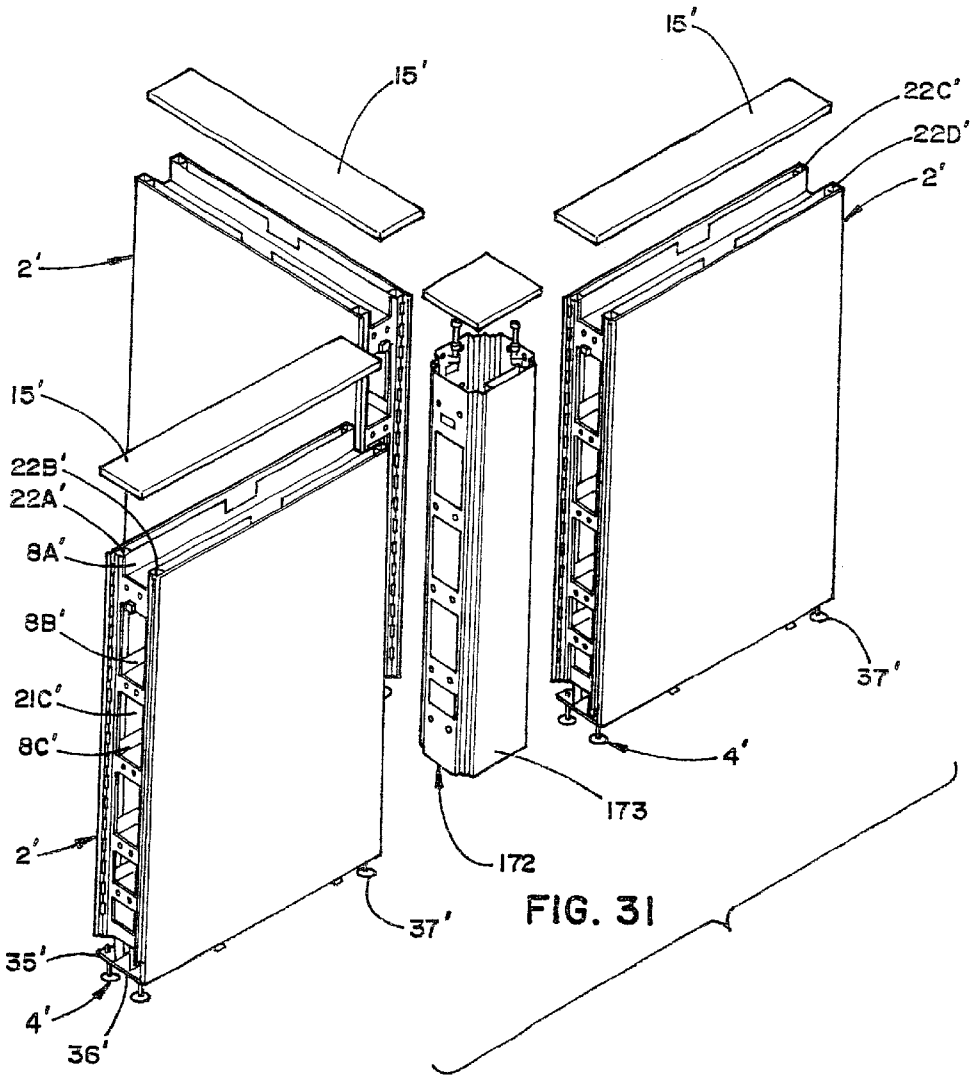
FIG. 31 is a perspective view of yet another embodiment of the present invention, wherein three utility panels are interconnected by a T-panel connector.

FIGS. 31 and 32 illustrate interconnecting three utility panels 2' in a T-configuration, using a T-connector 172. Each utility panel 2' has an inner bracket 81*a*' welded along the side edge thereof, with an associated outer bracket 81*b*' which form channels 100' in which flexible hinges 73' are received. An elongate cover 173 is mounted along the open side of the joint to enclose the same.

Figure 34:
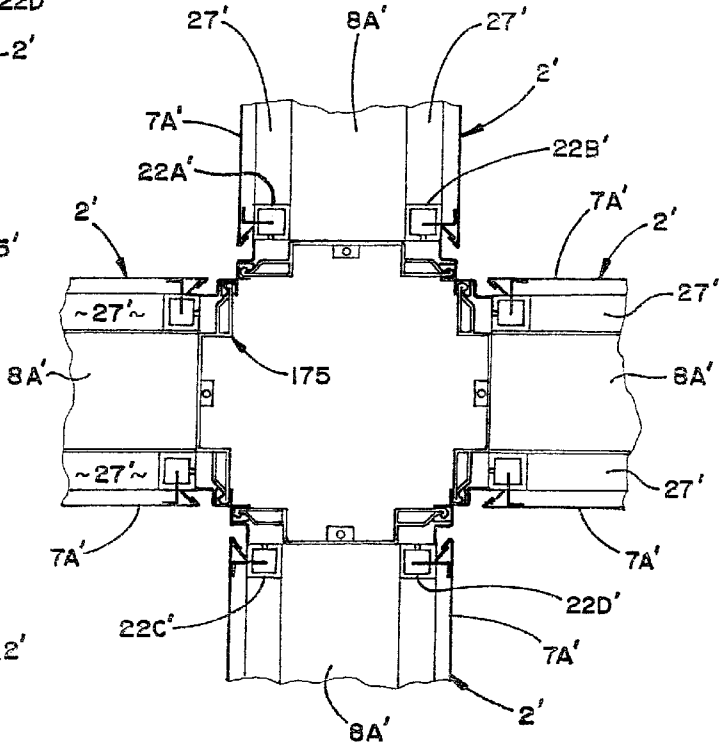
FIG. 34 is a fragmentary, horizontal cross-sectional view of the X-panel connector illustrated in FIG. 33.
Figure 33:
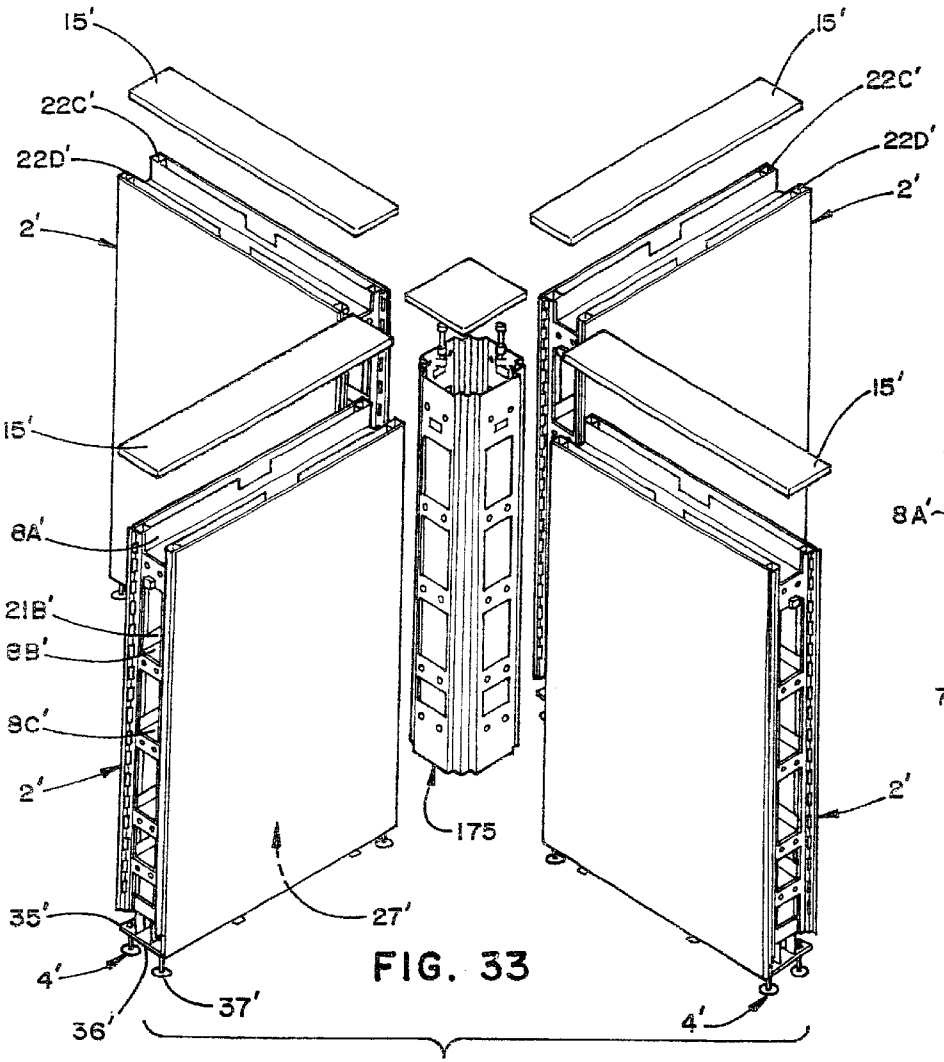
FIG. 33 is a perspective view of yet another embodiment of the present invention, wherein four utility panels are interconnected by an X-panel connector.

FIGS. 33 and 34 illustrate interconnecting four utility panels 2' in an X-configuration, using an X-connector 175. X-connector 175 is substantially identical to T-connector 172, except for the addition of an extra set of brackets 81' at the open side of the connector.

Figure 35:
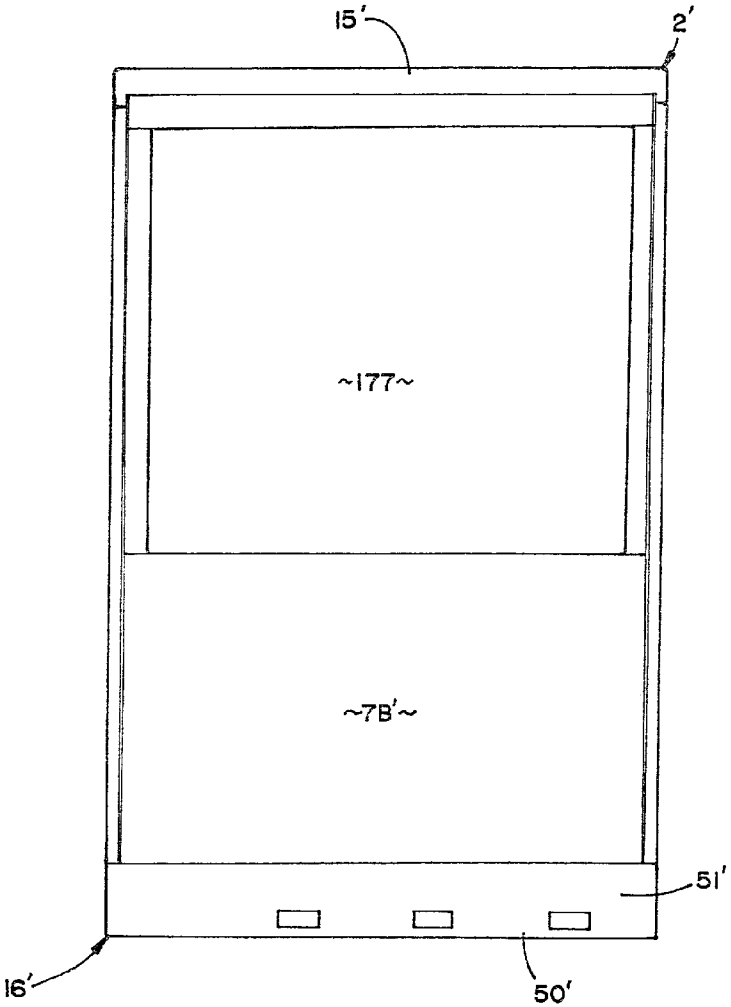
FIG. 35 is a front elevational view of yet another embodiment of the present invention.

FIG. 35 illustrates yet another embodiment of the present invention, wherein utility troughs 8*b*' and 8*c*' are detachably mounted within the associated panel frame 3'. In this manner, utility troughs 8*b*' and 8*c*' can be removed from frame 3', and the cover panels 7' reconfigured to create a window or pass through 177 area in utility panel 2'.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A freestanding upright partition for use in a modular office furniture system, the partition comprising:

a partial-height freestanding frame comprising:

at least two elongated internal frame members each having outward opposing faces defining spaced apart parallel forward and rearward planes when viewed from a side edge of the frame, the at least two frame members lying between the forward and rearward planes;

a plurality of elongated external frame members lying outboard of the forward and rearward planes, at least one of said external frame members being located along each said plane, each external frame member having an inward face and an outward face, the inward face of each external frame member engaging and being connected to at least some the associated outward faces of said internal frame members in an overlapping moment-resisting connection wherein the internal and external frame members include sections with flat surfaces that abuttingly engage and that lie on one of the forward and rearward planes; and a plurality of covers each connected to said frame and having an inner surface, an internal cavity being defined inward of the outward faces of said external frame members, and at least one utility management path being defined outward of said outward faces of the internal frame members and inward of the inner surfaces of the covers.

2. The upright partition defined in claim 1, wherein each of external frame members are interconnected to each of the internal frame members by overlapping moment-resisting connections.

3. The upright partition defined in claim 1, wherein at least one of said moment-resisting connections includes a weld for rigidly interconnecting the internal and external frame members.

4. The upright partition defined in claim 3, wherein said moment-resisting connections each include a weld securing the internal and external frame members together.

5. An upright partition for use in a modular office furniture system, the partition comprising:

a frame comprising:

at least two elongated internal frame members each having outward opposing faces defining spaced apart parallel forward and rearward planes when viewed from a side edge of the frame, the at least two frame members lying between the forward and rearward planes;

a plurality of elongated external frame members lying outboard of the forward and rearward planes at least one of said external frame members being located along each said plane, each external frame member having an inward face and an outward face, the inward face of each external frame member engaging and being connected to at least some the associated outward faces of said internal frame members in an overlapping moment-resisting connection wherein the internal and external frame members include sections with flat surfaces that abuttingly engage and that lie on one of the forward and rearward planes; and a plurality of covers each connected to said frame and having an inner surface, an internal cavity being defined inward of the outward faces of said external frame members, and at least one utility management path being defined outward of said outward laces of the internal frame members and inward of the inner surfaces of the covers, wherein said covers each include connectors for releasably engaging one or more of the external frame members.

6. The upright partition defined in claim 5, wherein at least one of said covers includes a concave inner surface.

7. The upright partition defined in claim 6, wherein said at least one cover is pan shaped.

8. The upright partition defined in claim 6, wherein said at least one cover includes a main panel comprising sheet metal.

9. An upright partition for use in a modular office furniture system, the partition comprising:

a frame comprising:

at least two elongated internal frame members each having outward opposing faces defining spaced apart parallel forward and rearward planes when viewed from a side edge of the frame, the at least two frame members lying between the forward and rearward planes;

a plurality of elongated external frame members lying outboard of the forward and rearward planes, at least one of said external frame members being located along each said plane, each external frame member having an inward face and an outward face, the inward face of each external frame member engaging and being connected to at least some the associated outward faces of said internal frame members in an overlapping moment-resisting connection wherein the internal and external frame members include sections with flat surfaces that abuttingly engage and that lie on one of the forward and rearward planes; and a plurality of covers each connected to said frame and having an inner surface, whereby an internal cavity is defined inward of the outward faces of said external frame members, and at least one utility management path is defined outward of said outward faces of the internal frame members and inward of the inner surfaces of the covers; said covers each include connectors for releasably engaging one or more of the external frame members; at least one of said covers including a concave inner surface; and wherein said at least one cover includes cover edges that are substantially flush with the outward faces of said external frame members.

10. The upright partition defined in claim 1, wherein at least some of said covers include metal providing electrical shielding for wires positioned in one of the first and second utility management paths.

11. The upright partition defined in claim 1, wherein at least one of the internal frame members and the external frame members extend horizontally a width of the frame so that one frame member can be aligned with a corresponding horizontal portion of an adjacent partition.

12. The upright partition defined in claim 1, including a horizontally-extending panel-to-panel connector for interconnecting said frame with an adjacent partition.

13. The upright partition defined in claim 1, including a top panel assembly having a second frame which mounts to the top of said frame of said upright partition to extend an overall height of the upright partition.

14. The upright partition defined in claim 13, wherein the second frame includes connectors that mateably engage an upper end of one or more of said internal and external frame members.

15. The upright partition defined in claim 14, wherein said top panel assembly includes a subframe having at least one vertical frame member configured to telescopingly engage the upper end of said one frame member on the first mentioned frame.

16. The upright partition defined in claim 15, wherein said top panel assembly includes a sheet-like panel mounted on said subframe.

17. The upright partition defined in claim 1, including a panel connector attached to a vertical side edge of said frame for connecting an adjacent non-aligned partition.

18. The upright partition defined in claim 1, wherein at least one of the internal and external frame members comprise tubular beams.

19. The upright partition defined in claim 18, wherein the plurality of external frame members each comprise tubular beams.

20. An upright partition for use in a modular office furniture system, the partition comprising:

a frame comprising:

at least two elongated internal frame members each having outward opposing faces defining spaced apart parallel forward and rearward planes when viewed from a side edge of the frame, the at least two frame members lying between the forward and rearward planes;

a plurality of elongated external frame members lying outboard of the forward and rearward planes, at least one of said external frame members being located along each said plane, each external frame member having an inward face and an outward face, the inward face of each external frame member engaging and being connected to at least some the associated outward faces of said internal frame members in an overlapping moment-resisting connection wherein the internal and external frame members include sections with flat surfaces that abuttingly engage and that lie on one of the forward and rearward planes; and a plurality of covers each connected to said frame and having an inner surface, an internal cavity being defined inward of the outward faces of said external frame members, and at least one utility management path being defined outward of said outward faces of the internal frame members and inward of the inner surfaces of the covers, wherein the plurality of external frame members are spaced apart and define therebetween at least one continuous and substantially uninterrupted passageway extending from end to end of the external frame members, the uninterrupted passageway forming a part of said internal cavity.

21. The upright partition defined in claim 20, wherein said external frame members extend continuously between opposing edges of said frame.

22. The upright partition defined in claim 21, wherein said external frame members each define a continuous cross sectional shape.

23. The upright partition defined in claim 20, wherein the at least two internal frame members are spaced apart and define therebetween at least one continuous and substantially uninterrupted second passageway extending transversely to the first-mentioned passageway and from end to end of the internal frame members, the second passageway forming a part of said internal cavity.

24. The upright partition defined in claim 23, wherein said internal frame members extend continuously between opposing edges of said frame.

25. The upright partition defined in claim 24, wherein said internal frame members each define a continuous cross sectional shape.

26. The upright partition defined in claim 1, wherein at least one of the internal and external frame members comprises an open channel that extends horizontally across the frame for supporting wires therein.

27. The upright partition defined in claim 1, wherein said plurality of external frame members include pairs of parallel external frame members, at least one of said external frame members of each pair being connected to the associated outward opposing faces of each said internal frame member.

28. The upright partition defined in claim 1, wherein one of said internal and external frame members include at least three frame members that are spaced from each other at uniform intervals.

29. The upright partition defined in claim 1, wherein each said cover includes hook-shaped clips for releasably coupling to at least one said external frame member.

30. An upright partition for use in a modular office furniture system, the partition comprising:

a frame comprising:

at least two elongated internal frame members each outward opposing faces defining spaced a part parallel forward and rearward planes when viewed from a side edge of the frame, the at least two frame members lying between the forward and rearward planes;

a plurality of elongated external frame members lying outboard of the forward and rearward planes, at least one of said external frame members being located along each said plane, each external frame member having an inward face and an outward face, the inward face of each external frame member engaging and being connected to at least some the associated outward faces of said internal frame members in an overlapping moment-resisting connection wherein the internal and external frame members include sections with flat surfaces that abuttingly engage and that lie on one of the forward and rearward planes; and a plurality of covers each connected to said frame and having an inner surface, an internal cavity being defined inward of the outward faces of said external frame members, and at least one utility management path being defined outward of said outward faces of the internal frame members and inward of the inner surfaces of the covers, wherein one of said internal and external frame members comprises a horizontal channel.

31. The upright partition defined in claim 1, wherein at least one of said internal and external frame members is U shaped in cross section.

32. The upright partition defined in claim 1, wherein the internal frame members comprise channels.

33. The upright partition defined in claim 1, including releasable securing means on at least one of said internal and external frame members for securing said one frame member to frames of like partitions in a modular assembly.

34. The upright partition defined in claim 1, wherein one of the internal and external frame members includes a series of vertically disposed slots in their outward faces that are constructed to receive and support hooked connectors for suspending furniture components upon the one frame members.

35. The upright partition defined in claim 1, including a furniture component mounted on the frame.

36. The upright partition defined in claim 35, wherein the furniture component includes a binder bin.

37. The upright partition defined in claim 1, wherein said covers include a configured cover defining an aperture whereby wires and cables can pass between the internal cavity of the frame and equipment external to the partition.

38. The upright partition defined in claim 37, wherein said configured cover includes a flexible strip for aesthetically covering the aperture.

39. The upright partition defined in claim 1, wherein at least one of said covers includes an electrical power outlet in an outward surface thereof.

40. The upright partition defined in claim 1, including cable support structure on said frame for supporting cables within said frame.

41. The upright partition defined in claim 40, wherein said cable support structure includes vertically extending cable-management members on one of said internal and external frame members.

42. The upright partition defined in claim 41, wherein said cable-management members include flanges on the internal frame members that define upwardly open pockets for receiving and holding cables therein.

43. The upright partition defined in claim 42, wherein said internal frame members define a channel including said flanges, said flanges including cutouts to permit convenient and managed ingress and egress of cables from the channels.

44. A partition system comprising at least two of the upright partitions defined in claim 1, the frames of said at least two upright partitions being preassembled separate units that are positioned adjacently and interconnected to form a wall covered by said plurality of covers.

* * * * *